US009441819B2

(12) United States Patent
Randolph et al.

(10) Patent No.: US 9,441,819 B2
(45) Date of Patent: Sep. 13, 2016

(54) MODULAR OPTIC FOR CHANGING LIGHT EMITTING SURFACE

(71) Applicant: Cree, Inc., Durham, NC (US)

(72) Inventors: David N. Randolph, Rougemont, NC (US); John R. Rowlette, Jr., Raleigh, NC (US); Craig Thomas Curtis, Raleigh, NC (US)

(73) Assignee: Cree, Inc., Durham, NC (US)

( * ) Notice: Subject to any disclaimer, the term of this patent is extended or adjusted under 35 U.S.C. 154(b) by 208 days.

(21) Appl. No.: 14/073,428

(22) Filed: Nov. 6, 2013

(65) Prior Publication Data

US 2014/0063810 A1 Mar. 6, 2014

Related U.S. Application Data

(63) Continuation-in-part of application No. 13/042,378, filed on Mar. 7, 2011, and a continuation-in-part of application No. 13/108,927, filed on May 16, 2011, now Pat. No. 8,573,816.

(60) Provisional application No. 61/413,949, filed on Nov. 15, 2010, provisional application No. 61/419,415, filed on Dec. 3, 2010, provisional application No. 61/452,671, filed on Mar. 15, 2011.

(51) Int. Cl.
*F21V 5/04* (2006.01)
*F21V 21/00* (2006.01)
(Continued)

(52) U.S. Cl.
CPC ..... *F21V 21/00* (2013.01); *F21K 9/00* (2013.01); *F21S 8/026* (2013.01); *F21V 5/04* (2013.01); *F21V 7/0091* (2013.01); *F21V 7/041* (2013.01); *F21V 7/09* (2013.01); *F21V 7/10* (2013.01); *F21V 13/04* (2013.01); *F21V 17/007* (2013.01); *F21V 21/04* (2013.01); *F21V 29/004* (2013.01); *F21V 29/507* (2015.01); *F21V 29/70* (2015.01);
(Continued)

(58) Field of Classification Search
CPC ..... F21V 11/16; F21V 11/08; F21V 11/12; F21L 15/04
See application file for complete search history.

(56) References Cited

U.S. PATENT DOCUMENTS 1,099,061 A 6/1914 Lane
1,230,844 A 6/1917 Blair et al.
(Continued)

FOREIGN PATENT DOCUMENTS

CN 3557377 8/2006
CN 201110496 Y 9/2008
(Continued)

OTHER PUBLICATIONS

Non-Final Office Action for U.S. Appl. No. 13/649,531, mailed Jun. 4, 2015, 9 pages.
(Continued)

*Primary Examiner* — Julie Bannan
(74) *Attorney, Agent, or Firm* — Withrow & Terranova, P.L.L.C.

(57) ABSTRACT

An LES is a surface from which light emanates from a lighting fixture. The present disclosure relates to a providing a lighting fixture that has an actual light emitting surface (A-LES), which is substantially smaller than the maximum potential LES (M-LES) for the lighting fixture. The M-LES is defined as the theoretical maximum LES for the mounting structure of the lighting fixture, and the A-LES is defined as the actual LES of the lighting fixture, as dictated by the lens or optical structures of the lighting fixture. The A-LES may provide an LES that is not only smaller, but also shaped differently, from the M-LES, to help control the light output of the lighting fixture based on the lighting application.

21 Claims, 44 Drawing Sheets

(51) Int. Cl.

| | |
|---|---|
| ***F21V 29/00*** | (2015.01) |
| ***F21K 99/00*** | (2016.01) |
| ***F21S 8/02*** | (2006.01) |
| ***F21V 21/04*** | (2006.01) |
| ***F21V 7/00*** | (2006.01) |
| ***F21V 7/04*** | (2006.01) |
| ***F21V 7/09*** | (2006.01) |
| ***F21V 7/10*** | (2006.01) |
| ***F21V 13/04*** | (2006.01) |
| ***F21V 17/00*** | (2006.01) |
| *F21Y 101/02* | (2006.01) |
| *F21Y 105/00* | (2016.01) |
| *F21V 29/507* | (2015.01) |
| *F21V 29/70* | (2015.01) |

(52) U.S. Cl.
CPC ..... *F21Y 2101/02* (2013.01); *F21Y 2105/001* (2013.01)

(56) References Cited

U.S. PATENT DOCUMENTS

D109,740 S 5/1938 Stewart
D134,595 S 11/1941 van Es
D158,821 S 5/1950 Walter
2,640,148 A 5/1953 McCandless
D199,141 S 9/1964 Curry
D231,679 S 5/1974 Keller
D231,680 S 5/1974 Keller
D238,185 S 12/1975 Wellward et al.
5,034,869 A 7/1991 Choi
5,103,381 A 4/1992 Uke
D325,999 S 5/1992 Sonneman
D326,537 S 5/1992 Gattari
D341,442 S 11/1993 Shapiro
5,477,441 A 12/1995 Budnovitch et al.
D375,605 S 11/1996 Balish, Jr.
D383,564 S 9/1997 Lecluze
5,664,869 A 9/1997 Bitton
D386,805 S 11/1997 Bonnette et al.
D392,764 S 3/1998 Balish, Jr.
D397,472 S 8/1998 Lecluze
D399,021 S 9/1998 Lam
5,800,038 A 9/1998 McCool
D399,590 S 10/1998 Lecluze
D400,274 S 10/1998 Ziaylek, Jr. et al.
D411,640 S 6/1999 Lueken et al.
D413,997 S 9/1999 Jandrisits et al.
D421,316 S 2/2000 Fiorato
D433,179 S 10/2000 Johnson
6,152,582 A 11/2000 Klaus
6,193,392 B1 2/2001 Lodhie
D457,677 S 5/2002 Landefeld et al.
D459,504 S 6/2002 Chen
D468,044 S 12/2002 Lam
6,491,407 B1 * 12/2002 Beadle ..... F21S 8/022 362/153
D468,477 S 1/2003 Landefeld et al.
D473,966 S 4/2003 Lecluze
D474,298 S 5/2003 Lecluze
D477,607 S 7/2003 Nonomura
6,644,834 B2 11/2003 Christen
D488,251 S 4/2004 Benghozi
D488,583 S 4/2004 Benghozi
D506,280 S 6/2005 Chen
6,913,371 B2 7/2005 Ping
D508,141 S 8/2005 Rashidi
D508,750 S 8/2005 Rashidi
D509,017 S 8/2005 Rashidi
D509,615 S 9/2005 Rashidi
6,948,829 B2 9/2005 Verdes et al.
D544,979 S 6/2007 Hartmann, Jr. et al.
D547,484 S 7/2007 Guercio
D548,390 S 8/2007 Lecluze
D549,384 S 8/2007 Grawunder
D558,377 S 12/2007 Rashidi
D558,378 S 12/2007 Rashidi
D560,204 S 1/2008 Bhavnani
D561,374 S 2/2008 Hartmann, Jr. et al.
D570,515 S 6/2008 Flaherty et al.
D574,104 S 7/2008 Sanoner
7,396,146 B2 7/2008 Wang
D588,296 S 3/2009 Sabernig
D588,735 S 3/2009 Woodard
D591,894 S 5/2009 Flank
7,549,772 B2 6/2009 Wang
D596,334 S 7/2009 Sabernig
7,614,769 B2 11/2009 Sell
D606,696 S 12/2009 Chen et al.
D607,140 S 12/2009 Farris et al.
7,631,987 B2 12/2009 Wei
D608,044 S 1/2010 Pickett
D609,840 S 2/2010 Tang
D610,292 S 2/2010 Yoshinobu et al.
7,677,767 B2 3/2010 Chyn
D614,337 S 4/2010 Robinson et al.
D617,934 S 6/2010 Rashidi
D622,434 S 8/2010 Ward et al.
7,771,086 B2 8/2010 Goverde
7,789,535 B2 9/2010 Wang et al.
D625,876 S 10/2010 Chen et al.
D625,879 S 10/2010 Sabernig
D626,676 S 11/2010 Johnson
D628,733 S 12/2010 Cobb, III et al.
7,862,214 B2 1/2011 Trott et al.
D632,822 S 2/2011 Bitton
D646,429 S 10/2011 Sabernig
8,104,928 B1 1/2012 Horn
D655,855 S 3/2012 Sabernig
D656,263 S 3/2012 Ogawa et al.
8,240,871 B2 8/2012 Chou
D671,259 S 11/2012 Chen
D671,668 S 11/2012 Rowlette, Jr. et al.
D672,899 S 12/2012 Van De Ven et al.
D674,127 S 1/2013 Rowlette, Jr. et al.
D692,171 S 10/2013 Randolph et al.
D694,456 S 11/2013 Rowlette, Jr. et al.
D695,941 S 12/2013 Rashidi
8,907,550 B2 12/2014 Zaderej et al.
2004/0050538 A1 3/2004 Sunder et al.
2005/0111234 A1 5/2005 Martin et al.
2006/0245184 A1 11/2006 Galli
2006/0263547 A1 11/2006 Cojocariu et al.
2007/0019409 A1 * 1/2007 Nawashiro ..... F21V 5/04 362/231
2007/0035951 A1 2/2007 Tseng
2007/0041220 A1 2/2007 Lynch
2008/0074889 A1 3/2008 Gloisten et al.
2008/0117637 A1 * 5/2008 Chang ..... F21V 29/004 362/294
2008/0158887 A1 7/2008 Zhu et al.
2009/0086492 A1 4/2009 Meyer
2009/0161356 A1 6/2009 Negley et al.
2009/0219727 A1 9/2009 Weaver
2009/0283779 A1 11/2009 Negley et al.
2010/0061076 A1 3/2010 Mandy et al.
2010/0110699 A1 5/2010 Chou
2010/0164348 A1 7/2010 Huang et al.
2010/0177509 A1 7/2010 Pickard
2010/0226139 A1 9/2010 Lynch et al.
2010/0296272 A1 11/2010 Roos et al.
2011/0002124 A1 1/2011 Chang et al.
2011/0026261 A1 2/2011 Kuan
2011/0255292 A1 10/2011 Shen
2012/0044704 A1 2/2012 Wilson et al.
2012/0051068 A1 3/2012 Pelton et al.
2012/0140490 A1 6/2012 Rowlette, Jr. et al.
2012/0230028 A1 9/2012 Foo
2013/0027938 A1 1/2013 Hisayasu
2013/0051012 A1 2/2013 Oehle et al.
2013/0141918 A1 6/2013 Harbers et al.
2013/0214665 A1 8/2013 Nezu
2014/0003061 A1 1/2014 Chen et al.

(56) References Cited

U.S. PATENT DOCUMENTS

| | | | |
|---|---|---|---|
| 2014/0292194 | A1 | 10/2014 | Sagal et al. |
| 2015/0043216 | A1 | 2/2015 | Du et al. |
| 2015/0062917 | A1 | 3/2015 | Yin |

FOREIGN PATENT DOCUMENTS

| | | | |
|---|---|---|---|
| EM | 000380670-0001 | | 8/2005 |
| FR | 2909160 | A1 | 5/2008 |
| WO | 2008036596 | A1 | 3/2008 |
| WO | 2008061082 | A1 | 5/2008 |
| WO | 2008067447 | A1 | 6/2008 |
| WO | 2009111905 | A1 | 9/2009 |
| WO | 2011037878 | A1 | 3/2011 |

OTHER PUBLICATIONS

Examination Report for German Patent Application No. 112012005131.9, mailed Aug. 5, 2015, 18 pages.
Final Office Action for U.S. Appl. No. 13/649,531, mailed Oct. 8, 2015, 8 pages.
International Preliminary Report on Patentability for PCT/US2012/067754, mailed Jun. 19, 2014, 8 pages.
Notice of Allowance for U.S. Appl. No. 13/042,388, mailed Jul. 21, 2014, 7 pages.
Non-final Office Action for U.S. Appl. No. 13/649,531, mailed Jul. 31, 2014, 7 pages.
Notice of Allowance for U.S. Appl. No. 29/469,362, mailed Mar. 25, 2014, 5 pages.
Quayle Action for U.S. Appl. No. 13/042,388, mailed May 27, 2014, 4 pages.
International Search Report for PCT/US2011/062990 mailed Apr. 12, 2012, 10 pages.
International Search Report for PCT/US2011/062992 mailed Apr. 2, 2012, 12 pages.
International Search Report for PCT/US2012/067754 mailed Feb. 20, 2013, 11 pages.
Quayle Action for U.S. Appl. No. 29/379,154, mailed May 30, 2012, 6 pages.
Non-Final Office Action for U.S. Appl. No. 13/042,378, mailed Sep. 4, 2012, 19 pages.
Final Office Action for U.S. Appl. No. 13/042,378, mailed Feb. 4, 2013, 20 pages.
Restriction Requirement for U.S. Appl. No. 29/408,232, mailed Jan. 16, 2013, 5 pages.
Examiners Answer to Appeal Brief for U.S. Appl. No. 13/042,378, mailed Aug. 6, 2013, 20 pages.
Jan. 5, 2016 Notice of Allowance for U.S. Appl. No. 29/456,927, mailed Sep. 18, 2013, 8 pages.
Non-Final Office Action for U.S. Appl. No. 13/042,388, mailed Oct. 18, 2013, 12 pages.
Notice of Allowance for U.S. Appl. No. 29/408,234, mailed Mar. 14, 2014, 5 pages.
First Office Action for Chinese Patent Application No. 201280023405.6, issued Dec. 9, 2014, 17 pages.
First Office Action for Chinese Patent Application No. 201280058225.7, issued Dec. 17, 2014, 29 pages.
Final Office Action for U.S. Appl. No. 13/649,531, mailed Dec. 16, 2014, 7 pages.
Second Office Action for Chinese Patent Application no. 201180058225.7, mailed Oct. 23, 2015, 24 pages.
Decision on Appeal for U.S. Appl. No. 13/042,378, mailed Nov. 30, 2015, 15 pages.
Non-Final Office Action for U.S. Appl. No. 14/073,446, mailed Nov. 17, 2015, 9 pages.
Advisory Action for U.S. Appl. No. 13/649,531, mailed Dec. 24, 2015, 3 pages.
First Examination Report for European Patent Application No. 11793990.0, mailed Apr. 5, 2016, 7 pages.
Notice of Allowance and Examiner-Initiated Interview Summary for U.S. Appl. No. 13/042,378, mailed Feb. 16, 2016, 12 pages.
Notice of Allowance and Examiner-Initiated Interview Summary for U.S. Appl. No. 14/073,446, mailed Apr. 1, 2016, 9 pages.
Supplemental Notice of Allowance for U.S. Appl. No. 13/042,378, mailed May 23, 2016, 4 pages.
Supplemental Notice of Allowance for U.S. Appl. No. 14/073,446, mailed May 24, 2016, 4 pages.
Third Office Action for Chinese Patent Application No. 201180058225.7, mailed May 10, 2016, 23 pages.
Notification of Refusal for German Patent Application No. 112012005131.9, mailed Apr. 11, 2016, 13 pages.
Supplemental Notice of Allowance for U.S. Appl. No. 14/073,446, mailed Jul. 14, 2016, 4 pages.

* cited by examiner

SECTION A-A

SECTION C-C

SECTION D-D

SECTION E-E

SECTION F-F

SECTION G-G

SECTION H-H

SECTION A-A

SECTION A-A

SECTION A-A

MODULAR OPTIC FOR CHANGING LIGHT EMITTING SURFACE

This application is a continuation-in-part of U.S. patent application Ser. No. 13/042,378, filed Mar. 7, 2011, which claims the benefit of U.S. provisional patent application Nos. 61/413,949 filed Nov. 15, 2010, and 61/419,415 filed Dec. 3, 2010, the disclosures of which are incorporated herein by reference in their entireties. This application is also a continuation-in-part of U.S. Pat. No. 8,573,816, which claims the benefit of U.S. provisional patent application No. 61/452,671, filed Mar. 15, 2011, the disclosures of which are incorporated herein by reference in their entireties. This application is related to U.S. patent application Ser. No. 14/073,446, entitled MODULAR OPTIC FOR CHANGING LIGHT EMITTING SURFACE, concurrently filed Nov. 6, 2013, the disclosure of which is incorporated herein by reference in its entirety.

FIELD OF THE DISCLOSURE

The present disclosure relates to lighting fixtures, and in particular, to a modular optic for a lighting fixture.

BACKGROUND

In recent years, a movement has gained traction to replace incandescent light bulbs with lighting fixtures that employ more efficient lighting technologies. One such technology that shows tremendous promise employs light emitting diodes (LEDs). Compared with incandescent bulbs, LED-based lighting fixtures are much more efficient at converting electrical energy into light and are longer lasting, and as a result, lighting fixtures that employ LED technologies are expected to replace incandescent bulbs in residential, commercial, and industrial applications.

Further, there are innumerable types of lighting applications that require light output with different beam shapes or like output characteristics. As such, there is a need for an effective and efficient way to change or modify the beam shape of the light output of an existing lighting fixture, and in particular an LED-based lighting fixture, based on the demands of the lighting application.

SUMMARY

An LES (light emitting surface) is a surface within a lighting fixture from which light emanates. The present disclosure relates to a providing a lighting fixture that has an actual light emitting surface (A-LES), which is substantially smaller than the maximum potential LES (M-LES) for the lighting fixture. The M-LES is defined as the theoretical maximum LES for the mounting structure of the lighting fixture, and the A-LES is defined as the actual LES of the lighting fixture, as dictated by the lens or optical structures of the lighting fixture. The A-LES may provide an LES that is not only smaller, but also shaped differently, from the M-LES, to help control the light output of the lighting fixture based on the lighting application.

In a first embodiment, the lighting fixture includes a mounting structure, an LED light source, and an internal optic. The mounting structure has a cavity and a front opening in communication with the cavity. The front opening defines the M-LES for the lighting fixture. The internal optic includes a shroud and an optic body. The shroud covers the front opening and has a light emitting opening. The optic body extends into the cavity of the mounting structure and toward the LED light source from the light emitting opening, which defines an A-LES for the lighting fixture that is substantially less than the M-LES.

A lens assembly may be provided that is removably attachable to the mounting structure and configured to cover the front opening of the mounting structure. When attached to the mounting structure, the lens assembly may hold the internal optic within the cavity of the mounting structure such that internal optic is not otherwise affixed to the mounting structure. As such, the light emitting opening of the internal optic defines an actual LES on the lens assembly that is substantially less than the maximum potential LES for the lighting fixture. Further, the internal optic may be modular and readily replaced with another internal optic that has a different LES, output beam characteristic, or a combination thereof.

In one embodiment, the front opening of the mounting structure has a first shape, and the light emitting opening has a second shape, which is substantially different from the first shape. Further, the light emitting opening may be centered on or offset from the center of the front opening of the mounting structure. The optic body may extend from the shroud and terminate at a light receiving opening, which is configured to receive and surround the LEDs of the LED light source.

Depending on the needs of the lighting application, the light receiving opening may have a first shape, and the light emitting opening may have a second shape, that is substantially the same or different from the first shape. The size of the light emitting and the light receiving openings may be the same or different. Further, the optic body may take on virtually any shape, such as conical, pyramidal, rectangular, polygonal, or the like. In certain embodiments, the actual LES has an area that is less than about 70%, 50%, 30%, or 20% of an area of the maximum potential LES.

In one embodiment, the mounting structure includes a heat spreading cup having a bottom panel, a rim, and at least one sidewall extending between the bottom panel and the rim. The LED light source is coupled inside the heat spreading cup to the bottom panel and configured to emit light in a forward direction through the front opening, which is formed by the rim, wherein the LED light source is thermally coupled to the bottom panel such that heat generated by the light source during operation is transferred radially outward along the bottom panel and in the forward direction along the at least one sidewall toward the rim.

In an alternative configuration, the lens and internal optic are integrated together to form an integrated lens assembly, which attaches to the mounting structure. The integrated lens assembly includes a shroud, an optic body, and a lens. The shroud covers the front opening and has a light emitting opening. The optic body extends into the cavity toward the LED light source from the light emitting opening, which defines an actual LES that is substantially less than the maximum potential LES. The lens is mounted such that the light emitted from the LED light source must pass through the lens before exiting the integrated lens assembly. The shroud may be configured to be removably attached to the mounting structure.

In a first configuration, the lens is mounted in and covers the light emitting opening. The lens may be mounted such that it is flush with the front surface of the shroud. In a second configuration, the lens is recessed into and mounted to an inside portion of the optic body. The optic body may include a channel formed on the inside portion of the optic body wherein at least a portion of the lens is mounted in the channel. In a third configuration, the lens may be replaced with a total internal reflector (TIR) and mounted as noted above.

In still another embodiment, the lighting fixture includes a mounting structure, an LED light source, a shroud, and a lens. The mounting structure has a cavity and a front opening in communication with the cavity. The front opening defines the M-LES for the lighting fixture. The shroud covers the front opening and has a light emitting opening, which defines an actual LES that is substantially less than the maximum potential LES. The lens extends into the cavity toward the LED light source from the light emitting opening. In one configuration, the lens is substantially parabolic and has a front portion mounted on the light emitting opening and a rear portion that has an opening that receives the LED light source.

As with the prior embodiments, the light receiving opening may have a first shape, and the light emitting opening may have a second shape, that is substantially the same or different from the first shape. The size of the light emitting and the light receiving openings may be the same or different. Further, the optic body may take on virtually any shape, such as conical, pyramidal, rectangular, polygonal, or the like. In certain embodiments, the actual LES has an area that is less than about 70%, 50%, 30%, or 20% of an area of the maximum potential LES.

Those skilled in the art will appreciate the scope of the disclosure and realize additional aspects thereof after reading the following detailed description in association with the accompanying drawings.

BRIEF DESCRIPTION OF THE DRAWINGS

The accompanying drawings incorporated in and forming a part of this specification illustrate several aspects of the disclosure, and together with the description serve to explain the principles of the disclosure.

DETAILED DESCRIPTION

Figure 1:
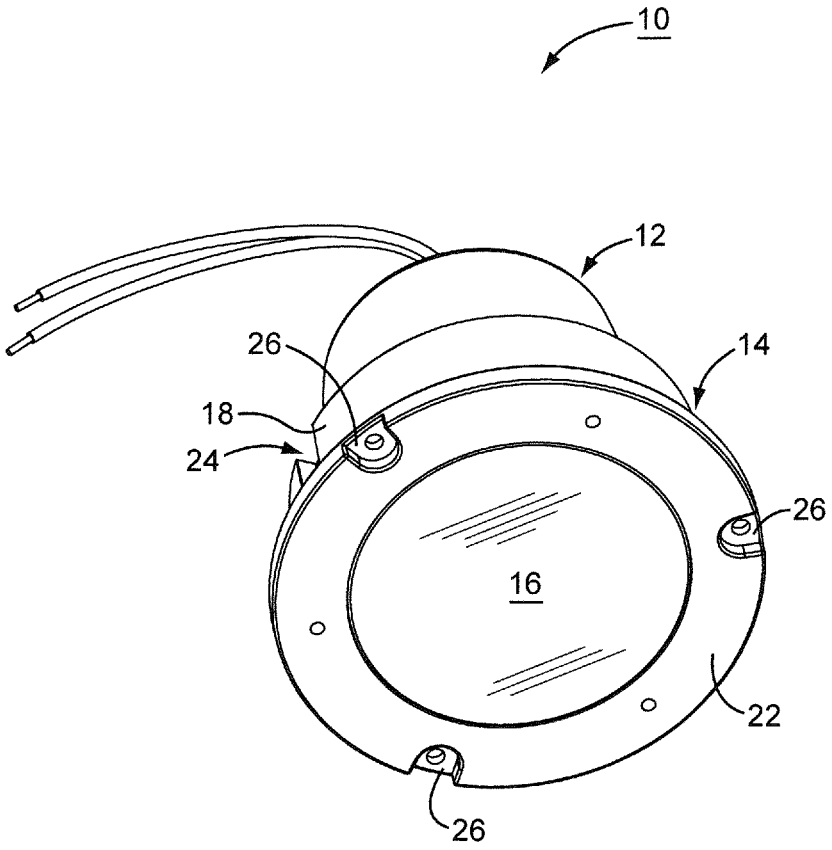
FIG. 1 (RELATED ART)
FIG. 1 is an isometric view of the front of the lighting fixture according to one embodiment of the disclosure.

The embodiments set forth below represent the necessary information to enable those skilled in the art to practice the disclosure and illustrate the best mode of practicing the disclosure. Upon reading the following description in light of the accompanying drawings, those skilled in the art will understand the concepts of the disclosure and will recognize applications of these concepts not particularly addressed herein. It should be understood that these concepts and applications fall within the scope of the disclosure.

It will be understood that relative terms such as "front," "forward," "rear," "below," "above," "upper," "lower," "horizontal," or "vertical" may be used herein to describe a relationship of one element, layer or region to another element, layer or region as illustrated in the figures. It will be understood that these terms are intended to encompass different orientations of the device in addition to the orientation depicted in the figures.

An LES (light emitting surface) is a surface within a lighting fixture from which light emanates. The present disclosure relates to a providing a lighting fixture that has an actual light emitting surface (A-LES), which is substantially smaller than the maximum potential LES (M-LES) for the lighting fixture. The M-LES is defined as the theoretical maximum LES for the mounting structure of the lighting fixture, and the A-LES is defined as the actual LES of the lighting fixture, as dictated by the lens or optical structures of the lighting fixture. The A-LES may provide an LES that is not only smaller, but also shaped differently, from the M-LES, to help control the light output of the lighting fixture based on the lighting application.

In a first embodiment, the lighting fixture includes a mounting structure, an LED light source, and an internal optic. The mounting structure has a cavity and a front opening in communication with the cavity. The front opening defines the M-LES for the lighting fixture. The internal optic includes a shroud and an optic body. The shroud covers the front opening and has a light emitting opening. The optic body extends into the cavity of the mounting structure and toward the LED light source from the light emitting opening, which defines an A-LES for the lighting fixture that is substantially less than the M-LES.

A lens assembly may be provided that is removably attachable to the mounting structure and configured to cover the front opening of the mounting structure. When attached to the mounting structure, the lens assembly holds the internal optic within the cavity of the mounting structure such that internal optic is not otherwise affixed to the mounting structure. As such, the light emitting opening of the internal optic defines an actual LES on the lens assembly that is substantially less than the maximum potential LES for the lighting fixture. Further, the internal optic is modular and can be readily replaced with another internal optic that has a different LES, output beam characteristic, or a combination thereof.

In one embodiment, the front opening of the mounting structure has a first shape, and the light emitting opening has a second shape, which is substantially different from the first shape. Further, the light emitting opening may be centered on or offset from the center of the front opening of the mounting structure. The optic body may extend from the shroud and terminate at a light receiving opening, which is configured to receive and surround the LEDs of the LED light source.

Depending on the needs of the lighting application, the light receiving opening may have a first shape, and the light emitting opening may have a second shape, that is substantially the same or different from the first shape. The size of the light emitting and the light receiving openings may be the same or different. Further, the optic body may take on virtually any shape, such as conical, pyramidal, rectangular, polygonal, or the like. In certain embodiments, the actual LES has an area that is less than about 70%, 50%, 30%, or 20% of an area of the maximum potential LES.

In an alternative configuration, the lens and internal optic are integrated together to form an integrated lens assembly, which attaches to the mounting structure. The integrated lens assembly includes a shroud, an optic body, and a lens. The shroud covers the front opening and has a light emitting opening. The optic body extends into the cavity toward the LED light source from the light emitting opening, which defines an actual LES that is substantially less than the maximum potential LES. The lens is mounted such that the light emitted from the LED light source must pass through the lens before exiting the integrated lens assembly. The shroud may be configured to be removably attached to the mounting structure.

In a first configuration, the lens is mounted in and covers the light emitting opening. The lens may be mounted such that it is flush with the front surface of the shroud. In a second configuration, the lens is recessed into and mounted to an inside portion of the optic body. The optic body may include a channel formed on the inside portion of the optic body wherein at least a portion of the lens is mounted in the channel. In a third configuration, the lens may be replaced with a total internal reflector (TIR) and mounted as noted above.

In still another embodiment, the lighting fixture includes a mounting structure, an LED light source, a shroud, and a lens. The mounting structure has a cavity and a front opening in communication with the cavity. The front opening defines the M-LES for the lighting fixture. The shroud covers the front opening and has a light emitting opening, which defines an actual LES that is substantially less than the maximum potential LES. The lens extends into the cavity toward the LED light source from the light emitting opening. In one configuration, the lens is substantially parabolic and has a front portion mounted on the light emitting opening and a rear portion that has an opening that receives the LED light source. Prior to delving into the details of these embodiments, an overview of an exemplary lighting fixture is provided in which the concepts of the disclosure may be implemented.

Figure 2:
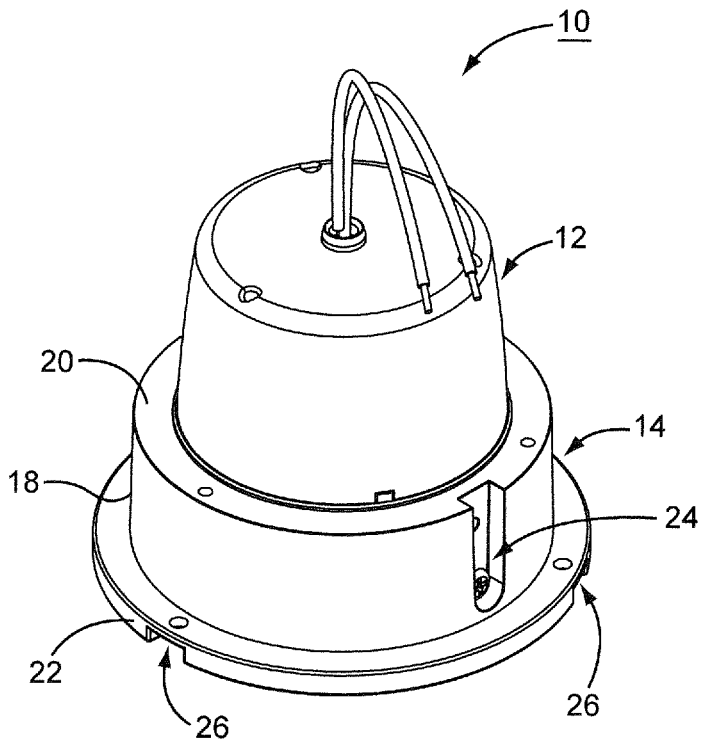
FIG. 2 (RELATED ART)
FIG. 2 is an isometric view of the back of the lighting fixture of FIG. 1.

FIGS. 1 and 2 illustrate a state-of-the-art lighting fixture 10, which is similar to the LMR2 and LMH2 series of lighting fixtures manufactured by Cree Inc. of Durham, N.C. Further details regarding this particular lighting fixture may be found in co-assigned U.S. patent application Ser. No. 13/042,378, which was filed Mar. 7, 2011, and entitled LIGHTING FIXTURE, the disclosure of which is incorporated herein by reference in its entirety. While this particular lighting fixture 10 is used for reference, those skilled in the art will recognize that virtually any type of solid-state lighting fixture may benefit from the concepts of this disclosure.

As shown, the lighting fixture 10 includes a control module 12, a mounting structure 14, and a lens assembly 16. The illustrated mounting structure 14 is cup-shaped and is capable of acting as a heat spreading device; however, different fixtures may include different mounting structures 14 that may or may not act as heat spreading devices. A light source (not shown), which will be described in detail further below, is mounted inside the mounting structure 14 and oriented such that light is emitted from the mounting structure through the lens assembly 16. The electronics (not shown) that are required to power and drive the light source are provided, at least in part, by the control module 12. While the lighting fixture 10 is envisioned to be used predominantly in 4, 5, and 6 inch recessed lighting applications for industrial, commercial, and residential applications, those skilled in the art will recognize the concepts disclosed herein are applicable to virtually any size or shape of lighting fixture.

The lens assembly 16 may include one or more lenses that are made of clear or transparent materials, such as polycarbonate or acrylic glass or any other suitable material. As discussed further below, the lens assembly 16 may be associated with a diffuser for diffusing the light emanating from the light source and exiting the mounting structure 14 via the lens assembly 16. Further, the lens assembly 16 may also be configured to help shape or direct the light exiting the mounting structure 14 via the lens assembly 16 in a desired manner.

The control module 12 and the mounting structure 14 may be integrated and provided by a single structure. Alternatively, the control module 12 and the mounting structure 14 may be modular wherein different sizes, shapes, and types of control modules 12 may be attached, or otherwise connected, to the mounting structure 14 and used to drive the light source provided therein.

In the illustrated embodiment, the mounting structure 14 is cup-shaped and includes a cylindrical sidewall 18 that extends between a bottom panel 20 at the rear of the mounting structure 14, and a rim, which may be provided by an annular flange 22 at the front of the mounting structure 14. One or more elongated slots 24 may be formed in the outside surface of the sidewall 18. There are two elongated slots 24, which extend parallel to a central axis of the lighting fixture 10 from the rear surface of the bottom panel 20 toward, but not completely to, the annular flange 22. The elongated slots 24 may be used for a variety of purposes, such as providing a channel for a grounding wire that is connected to the mounting structure 14 inside the elongated slot 24; connecting additional elements, such as heat sinks or external reflectors, to the lighting fixture 10; or as described further below, securely attaching the lens assembly 16 to the mounting structure 14.

The annular flange 22 may include one or more mounting recesses 26 in which mounting holes are provided. The mounting holes may be used for mounting the lighting fixture 10 to a mounting structure or for mounting accessories to the lighting fixture 10. The mounting recesses 26 provide for counter-sinking the heads of bolts, screws, or other attachment means below or into the front surface of the annular flange 22.

Figure 3:
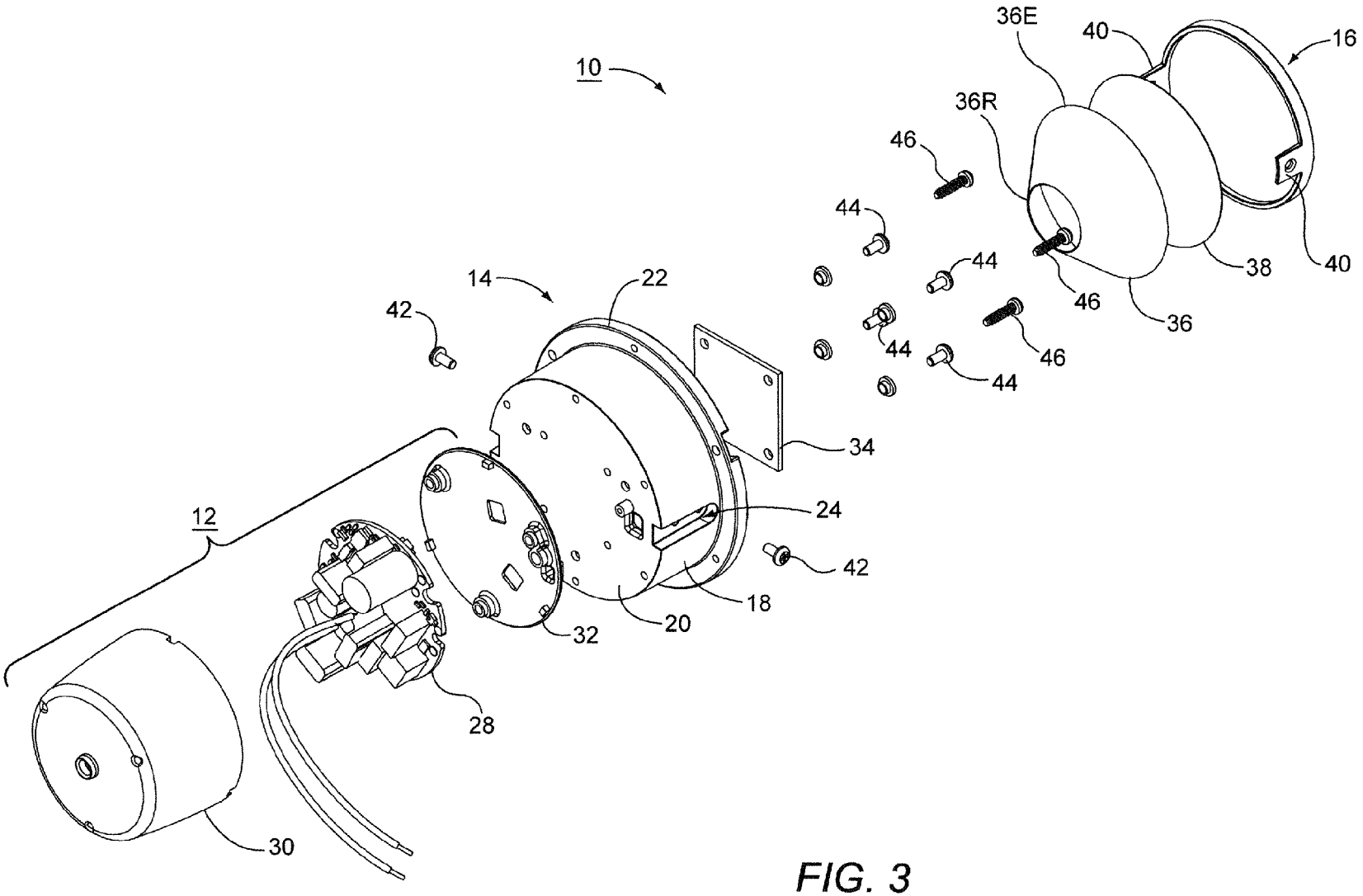
FIG. 3 is an exploded isometric view of the lighting fixture of FIG. 1.

With reference to FIG. 3, an exploded view of the lighting fixture 10 of FIGS. 1 and 2 is provided. As illustrated, the control module 12 includes control module electronics 28, which are encapsulated by a control module housing 30 and a control module cover 32. The control module housing 30 is cup-shaped and sized sufficiently to receive the control module electronics 28. The control module cover 32 provides a cover that extends substantially over the opening of the control module housing 30. Once the control module cover 32 is in place, the control module electronics 28 are contained within the control module housing 30 and the control module cover 32. The control module 12 is, in the illustrated embodiment, mounted to the rear surface of the bottom panel 20 of the mounting structure 14.

The control module electronics 28 may be used to provide all or a portion of power and control signals necessary to power and control the light source 34, which may be mounted on the front surface of the bottom panel 20 of the mounting structure 14 as shown, or in an aperture provided in the bottom panel 20 (not shown). Aligned holes or openings in the bottom panel 20 of the mounting structure 14 and the control module cover 32 are provided to facilitate an electrical connection between the control module electronics 28 and the light source 34. In an alternative embodiment (not shown), the control module 12 may provide a threaded base that is configured to screw into a conventional light socket wherein the lighting fixture resembles or is at least a compatible replacement for a conventional light bulb. Power to the lighting fixture 10 would be provided via this base.

In the illustrated embodiment, the light source 34 is solid state and employs one or more light emitting diodes (LEDs) and associated electronics, which are mounted to a printed circuit board (PCB) to generate light at a desired intensity and color temperature. The LEDs are mounted on the front side of the PCB while the rear side of the PCB is mounted to the front surface of the bottom panel 20 of the mounting structure 14 directly or via a thermally conductive pad (not shown). In this embodiment, the thermally conductive pad has a low thermal resistivity, and therefore, efficiently transfers heat that is generated by the light source 34 to the bottom panel 20 of the mounting structure 14.

While various mounting mechanisms are available, the illustrated embodiment employs four bolts 44 to attach the PCB of the light source 34 to the front surface of the bottom panel 20 of the mounting structure 14. The bolts 44 screw into threaded holes provided in the front surface of the bottom panel 20 of the mounting structure 14. Three bolts 46 are used to attach the mounting structure 14 to the control module 12. In this particular configuration, the bolts 46 extend through corresponding holes provided in the mounting structure 14 and the control module cover 32 and screw into threaded apertures (not shown) provided just inside the rim of the control module housing 30. As such, the bolts 46 effectively sandwich the control module cover 32 between the mounting structure 14 and the control module housing 30.

An internal optic 36 resides within the interior chamber provided by the mounting structure 14. In the illustrated embodiment, the internal optic 36 is essentially a reflector cone that has a conical wall that extends between a larger front opening and a smaller rear opening. The front opening is generally referred to the light emitting opening 36E of the internal optic 36, and the rear opening is referred to as the light receiving opening 36R. The light emitting opening 36E resides at and substantially corresponds to the dimensions of front opening in the mounting structure 14 that corresponds to the front of the interior chamber, or cavity, provided by the mounting structure 14. The light receiving opening 36R of the internal optic 36 resides about and substantially corresponds to the size of the LED or array of LEDs provided by the light source 34. The front surface of the internal optic 36 is generally, but not necessarily, highly reflective in an effort to increase the overall efficiency and optical performance of the lighting fixture 10. In certain embodiments, the internal optic 36 is formed from metal, paper, a polymer, or a combination thereof. In essence, the internal optic 36 provides a mixing chamber for light emitted from the light source 34 and may be used to help direct or control how the light exits the mixing chamber through the lens assembly 16.

Figure 4:
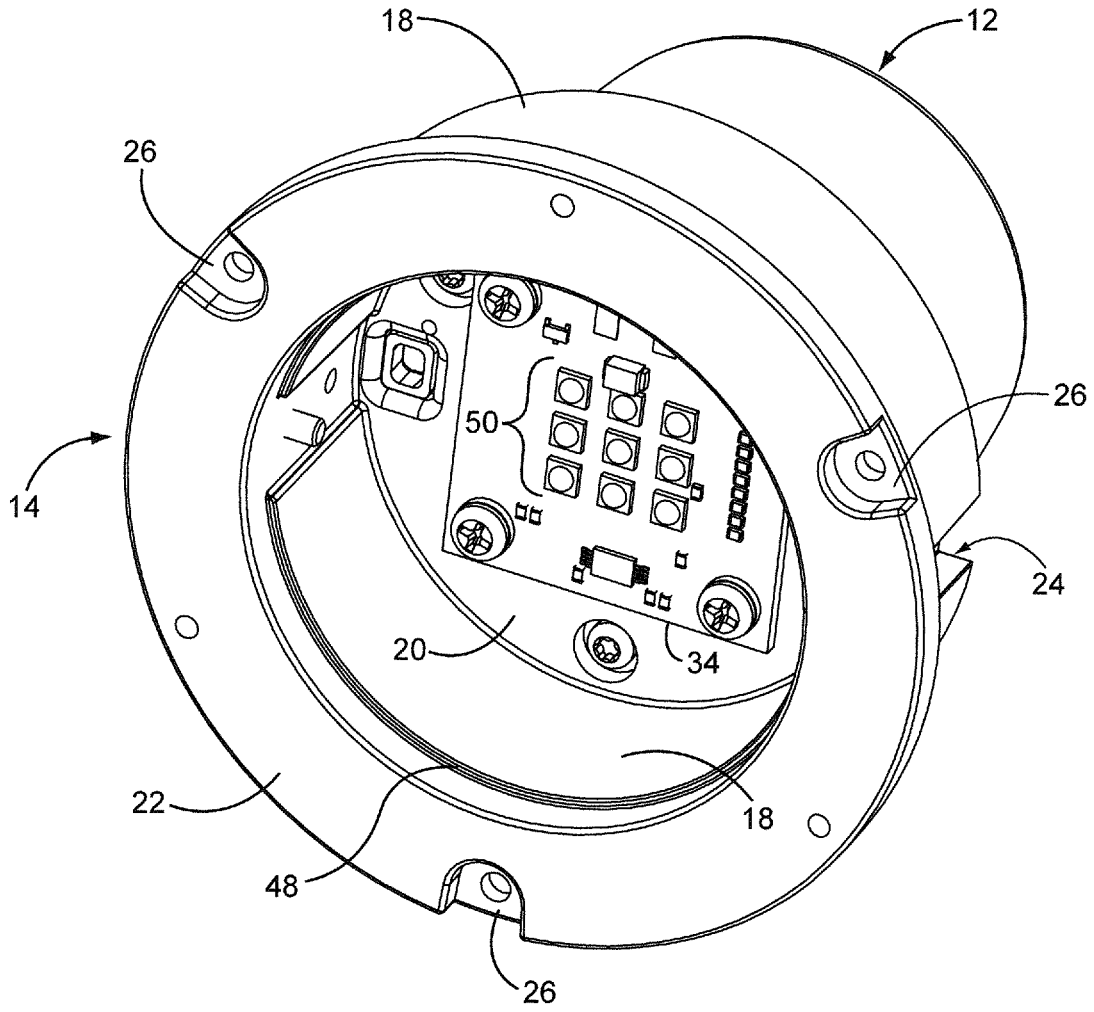
FIG. 4 is an isometric view of the front of the lighting fixture of FIG. 1 without the lens assembly, diffuser, and internal optic.
Figure 5:
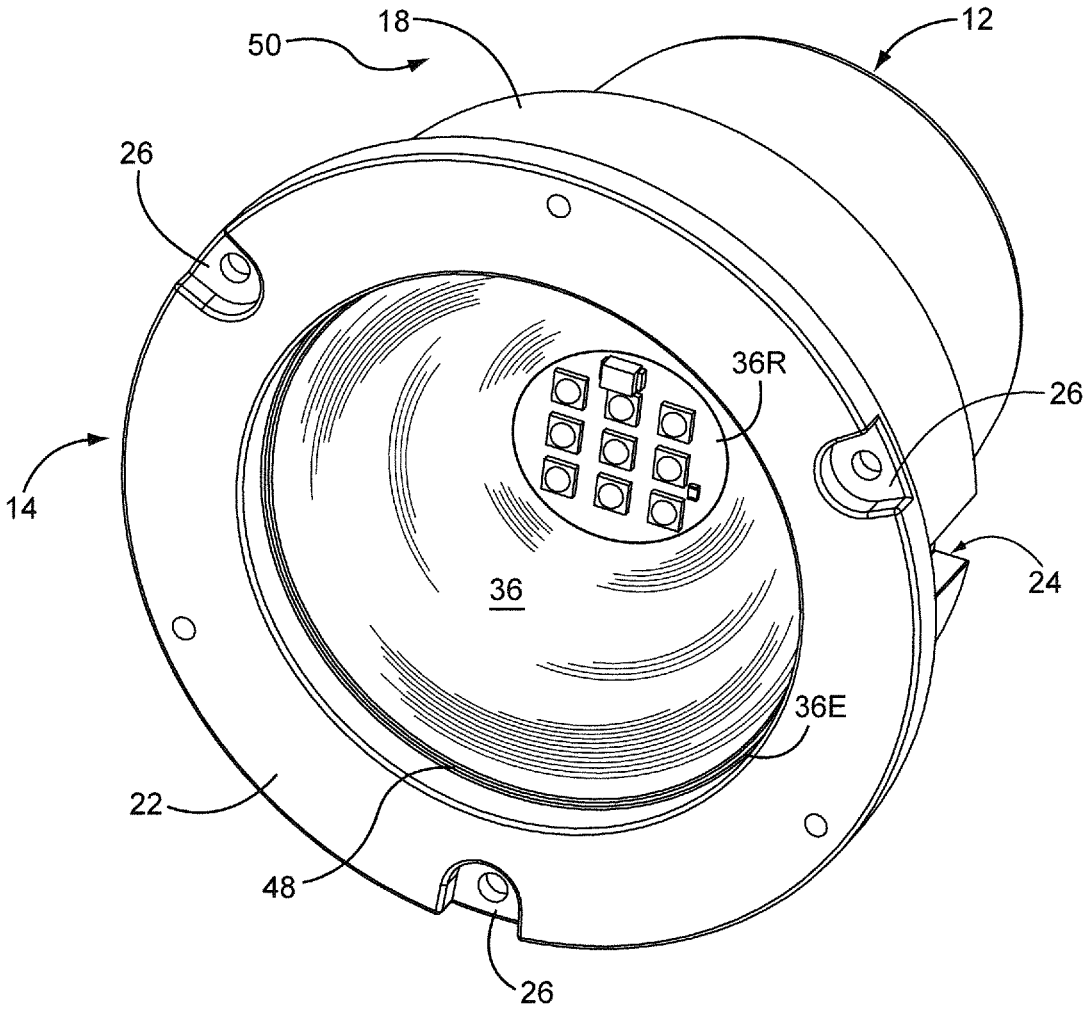
FIG. 5 is an isometric view of the front of the lighting fixture of FIG. 1 without the lens assembly and diffuser.

When assembled, the lens assembly 16 is mounted on or over the annular flange 22 and may be used to hold the internal optic 36 in place within the interior chamber of the mounting structure 14 as well as hold additional lenses and one or more planar diffusers 38 in place. In the illustrated embodiment, the lens assembly 16, the diffuser 38, and the light emitting opening 36E generally correspond in shape and size to the front opening of the mounting structure 14. The lens assembly 16 may be mounted such that the front surface of the lens assembly 16 is substantially flush with the front surface of the annular flange 22. As shown in FIGS. 4 and 5, a recess 48 is provided on the interior surface of the sidewall 18 and substantially around the opening of the mounting structure 14. The recess 48 provides a ledge on which the diffuser 38, the lens assembly 16, and perhaps an outer portion of the internal optic 36 rest inside the mounting structure 14. The recess 48 may be sufficiently deep such that the front surface of the lens assembly 16 is flush with the front surface of the annular flange 22.

Returning to FIG. 3, the lens assembly 16 may include tabs 40, which extend rearward from the outer periphery of the lens assembly 16. The tabs 40 may slide into corresponding channels on the interior surface of the sidewall 18 (see FIG. 4). The channels are aligned with corresponding elongated slots 24 on the exterior of the sidewall 18. The tabs 40 have threaded holes that align with holes provided in the grooves and elongated slots 24. When the lens assembly 16 resides in the recess 48 at the front opening of the mounting structure 14, the holes in the tabs 40 will align with the holes in the elongated slots 24. Bolts 42 may be inserted through the holes in the elongated slots and screwed into the threaded holes provided in the tabs 40 to affix the lens assembly 16 to the mounting structure 14. When the lens assembly 16 is secured, the diffuser 38 is sandwiched between the lens assembly and the recess 48, and the internal optic 36 is contained between the diffuser 38 and the light source 34. If the diffuser 38 is not used or is integrated with the lens assembly 16, the internal optic 36 is contained between the lens assembly 16 and the light source 34. Alternatively, a retention ring (not shown) may attach to the flange 22 of the mounting structure 14 and operate to hold the lens assembly 16 and diffuser 38 in place.

The degree and type of diffusion provided by the diffuser 38 may vary from one embodiment to another. Further, color, translucency, or opaqueness of the diffuser 38 may vary from one embodiment to another. Separate diffusers 38, such as that illustrated in FIG. 3, are typically formed from a polymer, glass, or thermoplastic, but other materials are viable and will be appreciated by those skilled in the art. Similarly, the lens assembly 16 is planar and generally corresponds to the shape and size of the diffuser 38 as well as the front opening of the mounting structure 14. As with the diffuser 38, the material, color, translucency, or opaqueness of the lens assembly 16 may vary from one embodiment to another. Further, both the diffuser 38 and the lens assembly 16 may be formed from one or more materials or one or more layers of the same or different materials. While only one diffuser 38 and one lens assembly 16 are depicted, the lighting fixture 10 may have multiple diffusers 38 or lens assemblies 16.

Figure 6A:
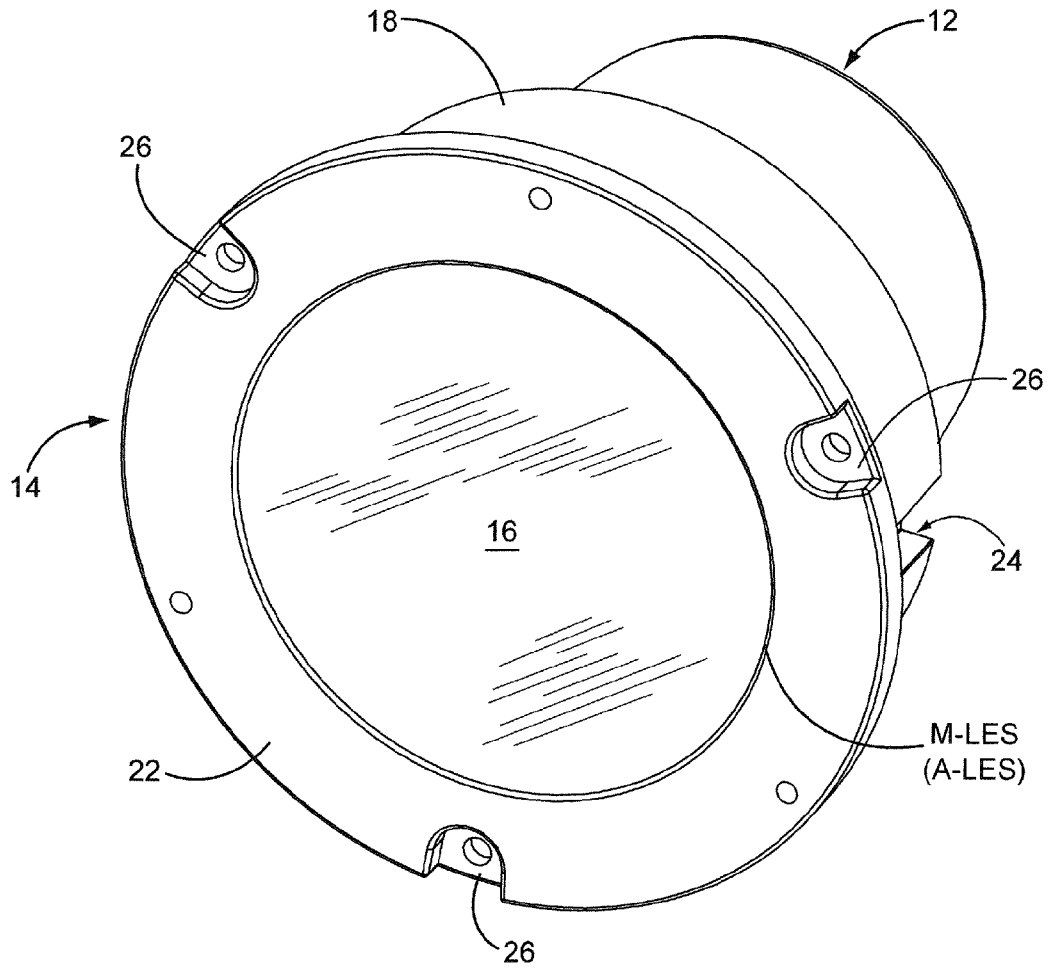
FIG. 6A is an isometric view of the front of the lighting fixture of FIG. 1 with the lens assembly.
Figure 6B:
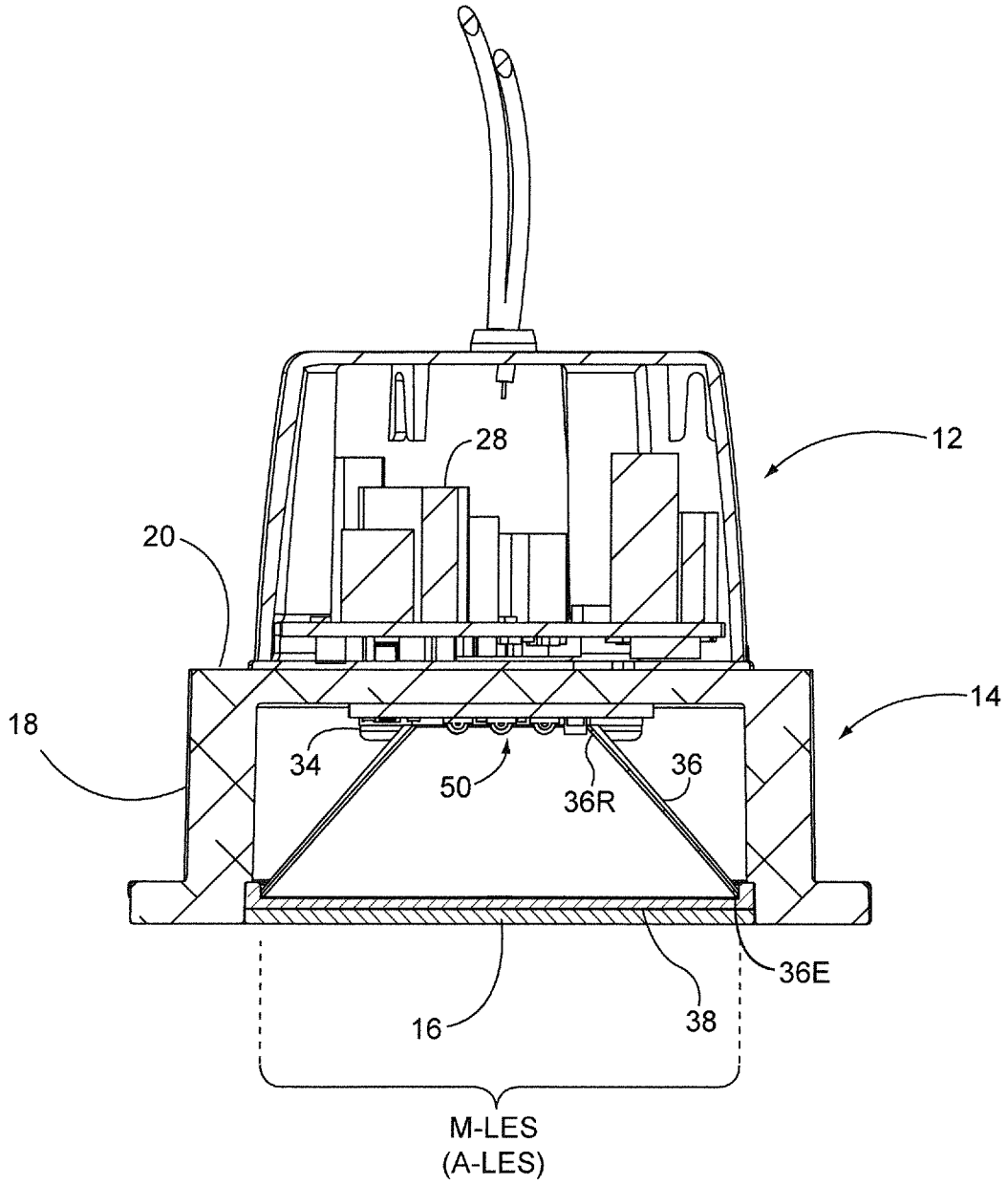
FIG. 6B is a cross sectional view of the lighting fixture of FIG. 5.

For LED-based applications, the light source 34 provides a single LED or an array of LEDs 50, as illustrated in FIG. 4. FIG. 4 illustrates a front isometric view of the lighting fixture 10, with the lens assembly 16, diffuser 38, and internal optic 36 removed, such that the light source 34 and the array of LEDs 50 are clearly visible within the mounting structure 14. FIG. 5 illustrates a front isometric view of the lighting fixture 10 with the lens assembly 16 and diffuser 38 removed and the internal optic 36 in place, such the array of LEDs 50 of the light source 34 are aligned with the light receiving opening 36R of the internal optic 36. As noted above, the volume inside the internal optic 36 and bounded by the light receiving opening 36R of the internal optic 36 and the lens assembly 16 or diffuser 38 provides a mixing chamber. FIG. 6A illustrates a front isometric view of the lighting fixture 10 with the lens assembly 16 in place. FIG. 6B illustrates a cross-section of the lighting fixture 10.

Light emitted from the array of LEDs 50 is mixed inside the mixing chamber formed by the internal optic 36 (not shown) and directed out through the lens assembly 16 in a forward direction to form a light beam. The array of LEDs 50 of the light source 34 may include LEDs 50 that emit different colors of light. For example, the array of LEDs 50 may include both red LEDs that emit red light and blue-shifted yellow (BSY) LEDs that emit bluish-yellow light, wherein the red and bluish-yellow light is mixed to form "white" light at a desired color temperature. For additional information, reference is made to co-assigned U.S. Pat. No. 7,213,940, which is incorporated herein by reference in its entirety. For a uniformly colored light beam, relatively thorough mixing of the light emitted from the array of LEDs 50 is desired. Both the internal optic 36 and the diffusion provided by the diffuser 38 may play a significant role in mixing the light emanated from the array of LEDs 50 of the light source 34.

In particular, certain light rays, which are referred to as non-reflected light rays, emanate from the array of LEDs 50 and exit the mixing chamber through the diffuser 38 and lens assembly 16 without being reflected off of the interior surface of the internal optic 36. Other light rays, which are referred to as reflected light rays, emanate from the array of LEDs of the light source 34 and are reflected off of the front surface of the internal optic 36 one or more times before exiting the mixing chamber through the diffuser 38 and lens assembly 16. With these reflections, the reflected light rays are effectively mixed with each other and at least some of the non-reflected light rays within the mixing chamber before exiting the mixing chamber through the diffuser 38 and the lens assembly 16.

As noted above, the diffuser 38 functions to diffuse, and as result mix, the non-reflected and reflected light rays as they exit the mixing chamber, wherein the mixing chamber and the diffuser 38 provide the desired mixing of the light emanated from the array of LEDs 50 of the light source 34 to provide a light beam of a consistent color. In addition to mixing light rays, the lens assembly 16 and diffuser 38 may be designed and the internal optic 36 shaped in a manner to control the relative concentration and shape of the resulting light beam that is projected from the lighting fixture 10. For example, a first lighting fixture 10 may be designed to provide a concentrated beam for a spotlight, wherein another may be designed to provide a widely dispersed beam for a floodlight. From an aesthetics perspective, the diffusion provided by the diffuser 38 also prevents the emitted light from looking pixelated and obstructs the ability for a user to see the individual LEDs of the array of LEDs 50.

As provided in the above embodiment, the more traditional approach to diffusion is to provide a diffuser 38 that is separate from the lens assembly 16. As such, the lens assembly 16 is effectively transparent and does not add any intentional diffusion. The intentional diffusion is provided by the diffuser 38. In most instances, the diffuser 38 and lens assembly 16 are positioned next to one another. In an effort to minimize part counts and ease manufacturing complexity, a diffusion film may be applied directly on one or both surfaces of the lens assembly 16. Alternatively, the lens assembly 16 may be configured to provide the functions of both a traditional lens assembly 16 and either a diffuser 38 or diffusion film 38F. Details are provided in U.S. patent application Ser. Nos. 13/042,378 and 13/108,927, which are incorporated herein by reference.

As noted above, a light emitting surface (LES) is a surface area within a lighting fixture 10 from which light emanates. For the purposes of this disclosure and the accompanying claims, the terms maximum potential LES (M-LES) and actual LES (A-LES) are defined as follows. The M-LES is defined as the theoretical maximum LES for the mounting structure 14 of the lighting fixture 10. The M-LES essentially corresponds to the front opening of the mounting structure 14. The A-LES is defined as the actual LES of the lighting fixture 10, as dictated by the lens assembly 16, internal optic 36, or the like. The A-LES may be substantially less than the M-LES for the mounting structure 14 of the lighting fixture 10. In respective embodiments, the A-LES has an area that is less than about 70%, 50%, 30%, or 20% of an area of the M-LES.

As described further below, the A-LES may provide a surface that is not only smaller, but also shaped differently, from the M-LES, to help control the light output of the lighting fixture. Each lighting fixture 10 will generally have an A-LES and be associated with a theoretical M-LES. Actual light output is controlled by the A-LES, and the M-LES is simply a reference to help define the inventive concepts disclosed herein.

With reference to FIGS. 6A and 6B, the front opening of the mounting structure 14 corresponds to the front surface of the lens assembly 16. Since the light emitting opening 36E of the internal optic 36 generally corresponds to both the front opening of the mounting structure 14 and the lens assembly 16, light will emanate through the entirety of the front surface of the lens assembly 16. As such, the M-LES and the A-LES are essentially the same and generally corresponds to the entirety of the front surface of the lens assembly 16 as well as the entirety of the front opening of the mounting structure 14.

In the embodiments that follow, the internal optic 36, the lens assembly 16, or a combination thereof is altered such that the A-LES for the lighting fixture 10 is substantially reduced from the M-LES to achieve various light output goals. In each embodiment, the mounting structure 14 is kept unchanged simply to illustrate the degree of change that is possible for a given fixture construction by altering these components. Those skilled in the art will recognize that the concepts disclosed herein are applicable to virtually any shape or size of lighting fixture 10.

Figure 7:
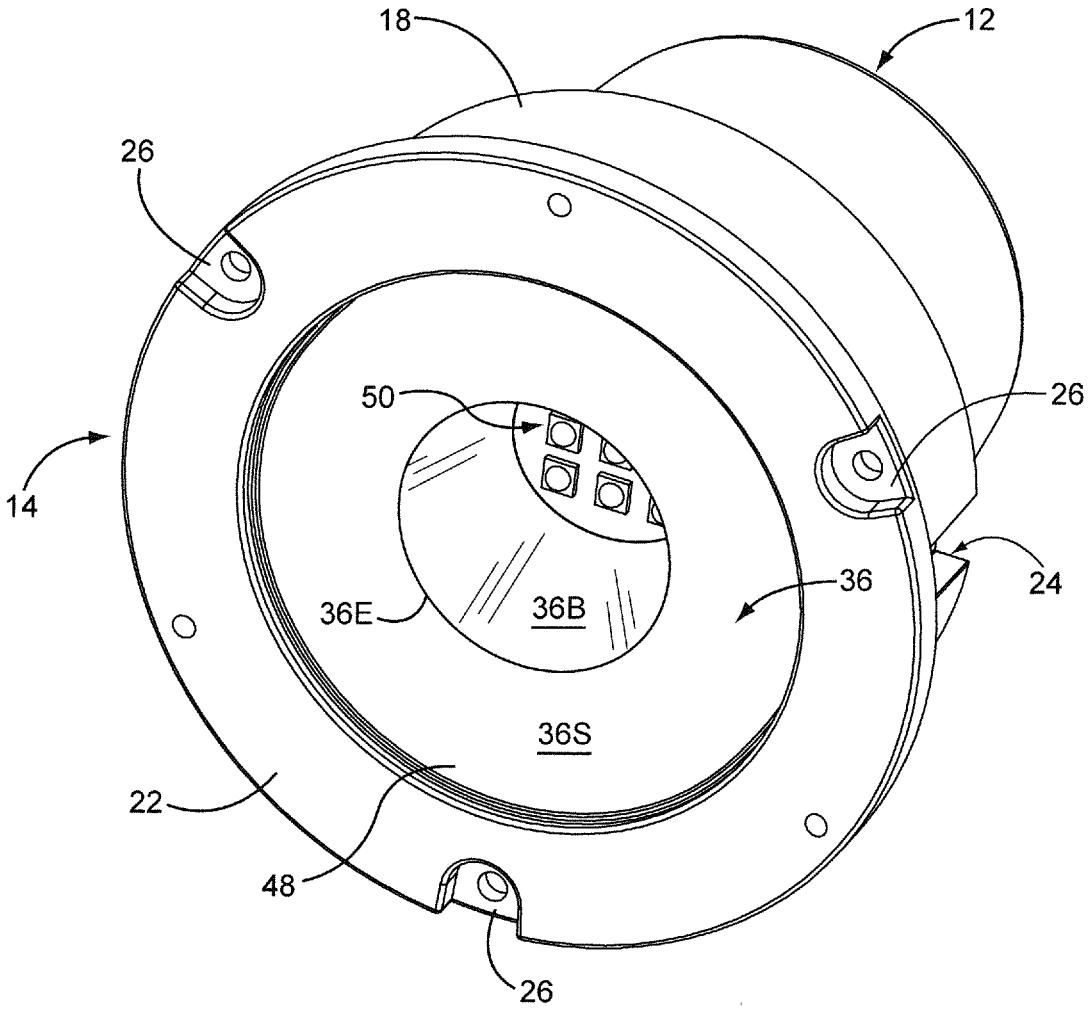
FIG. 7 is an isometric view of the front of a lighting fixture without the lens assembly and with an internal optic, according to one embodiment of the disclosure.

FIG. 7 illustrates a front isometric view of the lighting fixture 10 with the lens assembly 16 and diffuser 38 removed and the internal optic 36 in place, such the array of LEDs 50 of the light source 34 are aligned with the light receiving opening 36R of the internal optic 36. In this embodiment, the internal optic 36 is modified to such that the light emitting opening 36E is substantially smaller than the front opening of the mounting structure 14, and as such is smaller than the M-LES of the lighting fixture 10.

Details of the internal optic for this embodiment are illustrated in respective front isometric, bottom isometric, side, and cross-sectional views in FIGS. 8A-8D. The internal optic 36 has an annular shroud 36S with the light emitting opening 36E centrally located therein. A tubular optic body 36B is conical, extends rearward from the light emitting opening 36E, and terminates at the light receiving opening 36R. The diameter of the conical optic body 36B linearly increases from the smaller light receiving opening 36R to the larger light emitting opening 36E.

Figure 8A:
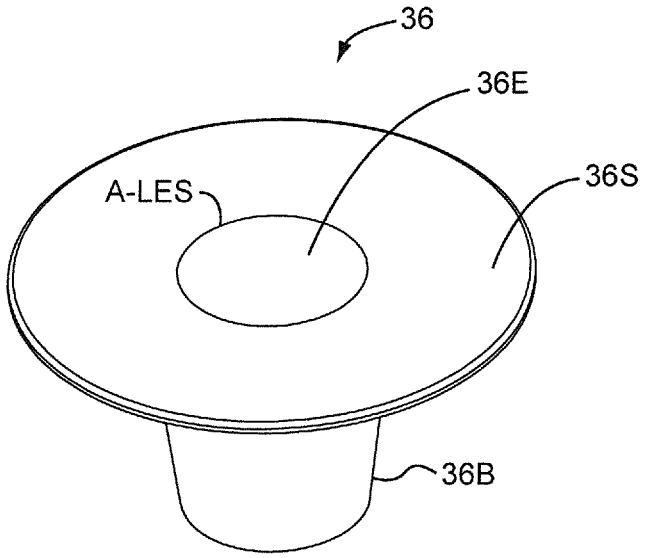
FIGS. 8A-8D are respective front isometric, rear isometric, side plan, and cross-sectional views of the internal optic of FIG. 7.
Figure 8B:
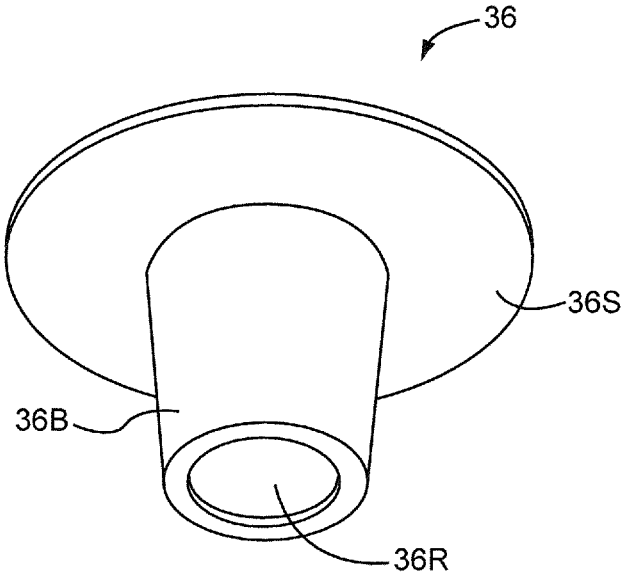
Figure 8C:
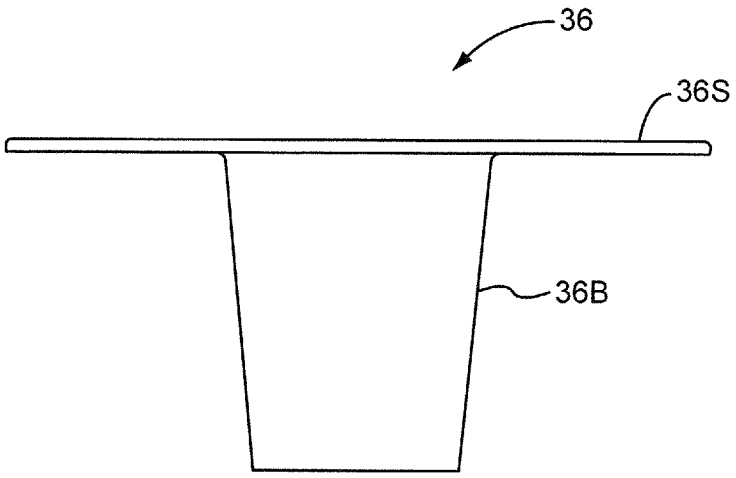
Figure 8D:
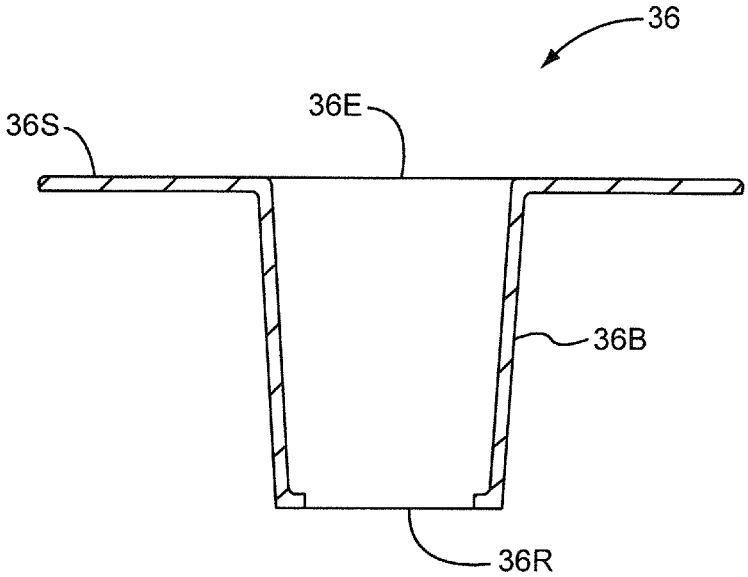
Figure 8E:
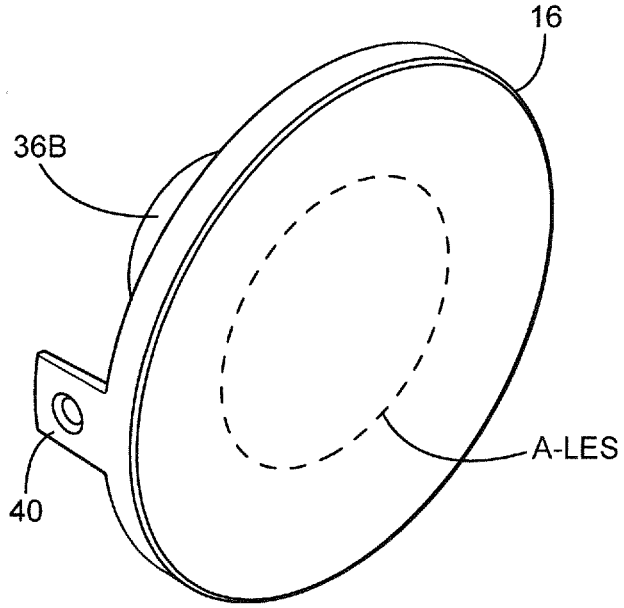
FIGS. 8E and 8F are front isometric and rear isometric views of the internal optic of FIG. 7 recessed in the rear of the lens assembly.
Figure 8F:
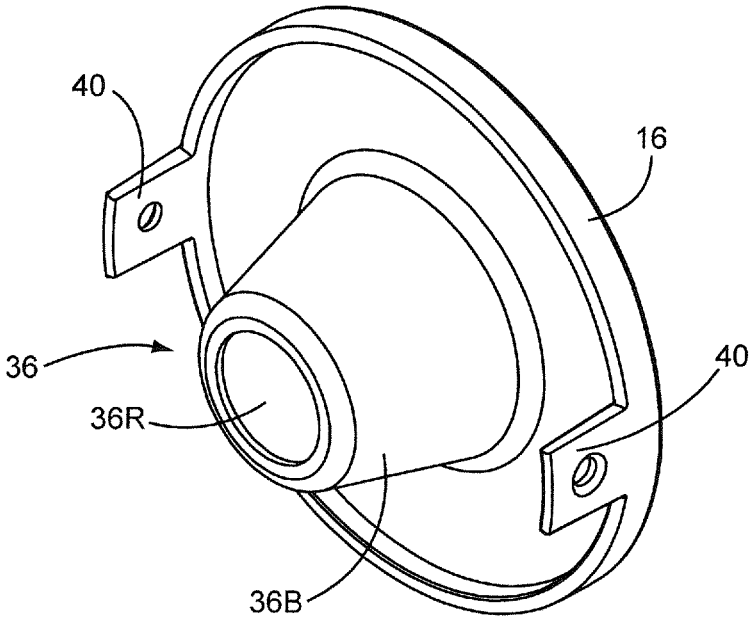

FIGS. 8E and 8F illustrate front and rear isometric views of the internal optic 36 residing in position within the lens assembly 16. As shown, a rearward-extending rim that runs around the perimeter of the lens assembly 16 receives the shroud 36S. The rest of the lighting fixture 10 is not illustrated. When used with the lens assembly 16, the circular A-LES on the lens assembly 16 will correspond to the circular light emitting opening 36E, as illustrated in the front isometric view of FIG. 8E.

Figure 9A:
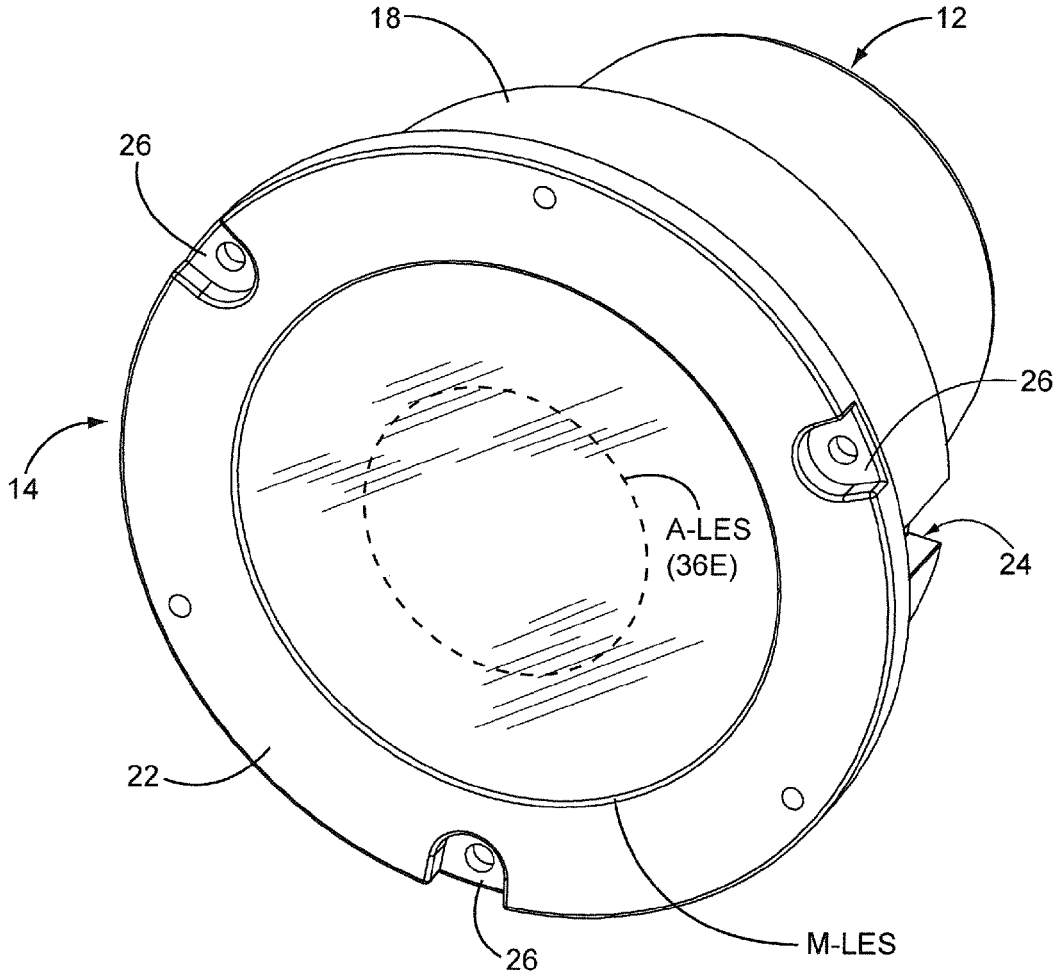
FIG. 9A is a front isometric view of the lighting fixture wherein the A-LES is illustrated when using the internal optic of FIG. 7.
Figure 9B:
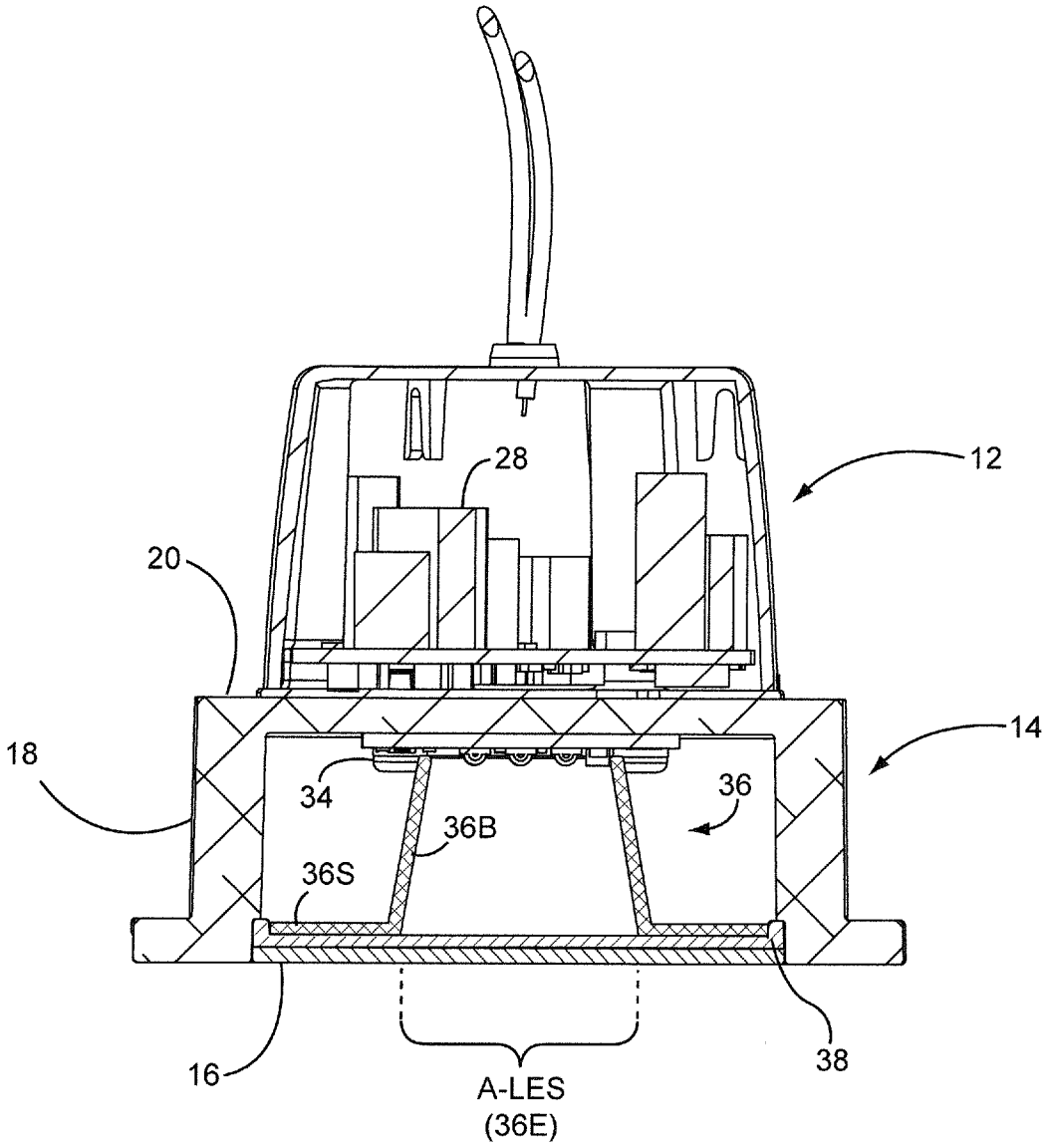
FIG. 9B is a cross-sectional view of the lighting fixture of FIG. 7.

FIG. 9A depicts the lighting fixture 10 with the lens assembly 16 installed. The A-LES is identified by the dashed line on the front surface of the lens assembly 16 and corresponds to the light receiving opening 36R of the internal optic 36. The A-LES is substantially smaller than the M-LES, which corresponds to the entirety of the front surface of the lens assembly 16, in this embodiment. While smaller in area, the A-LES has substantially the same shape, a circle, as the M-LES. FIG. 9B provides a cross-sectional view of the lighting fixture 10 with the internal optic 36 and the lens assembly 16 in place. Notably, the diffuser 38 is provided between the lens assembly 16 and the shroud 36S of the internal optic 36. Diffusion in general is optional, as is the diffuser 38. If diffusion is desired, but the diffuser 38 is undesirable, diffusion may also be integrated into all or at least the portion of the lens assembly 16 associated with the A-LES, as described further below.

As such, a lens assembly 16 may be provided that is removably attachable to the mounting structure 14 and configured to cover the front opening of the mounting structure 14. When attached to the mounting structure 14, the lens assembly 16 may hold the internal optic 36 within the cavity of the mounting structure 14, such that internal optic 36 is not otherwise affixed to the mounting structure 14. As such, the light emitting opening 36E of the internal optic 36 defines on the lens assembly 16 an actual LES that is substantially less than the maximum potential LES for the lighting fixture 10. Further, the internal optic 36 is modular and can be readily replaced with another internal optic 36 that has a different LES (A-LES), output beam characteristic, or a combination thereof.

In one embodiment, the front opening of the mounting structure 14 has a first shape, and the light emitting opening 36E has a second shape, which is substantially different from the first shape. Further, the light emitting opening 36E may be centered on or offset from the center of the front opening of the mounting structure 14. The optic body 36B may extend from the shroud 36S and terminate at a light receiving opening 36R, which is configured to receive and surround the LEDs 50 of the LED light source 34.

Depending on the needs of the lighting application, the light receiving opening 36R may have a first shape, and the light emitting opening 36E may have a second shape, that is substantially the same or different from the first shape. The size of the light emitting opening 36E and the light receiving opening 36R may be the same or different. Further, the optic body 36B may take on virtually any shape, such as conical, pyramidal, rectangular, polygonal, or the like. In certain embodiments, the actual LES has an area that is less than about 70%, 50%, 30%, or 20% of an area of the maximum potential LES. These characteristics of the optic body 36B apply the various embodiments that are described below.

Figure 9C:
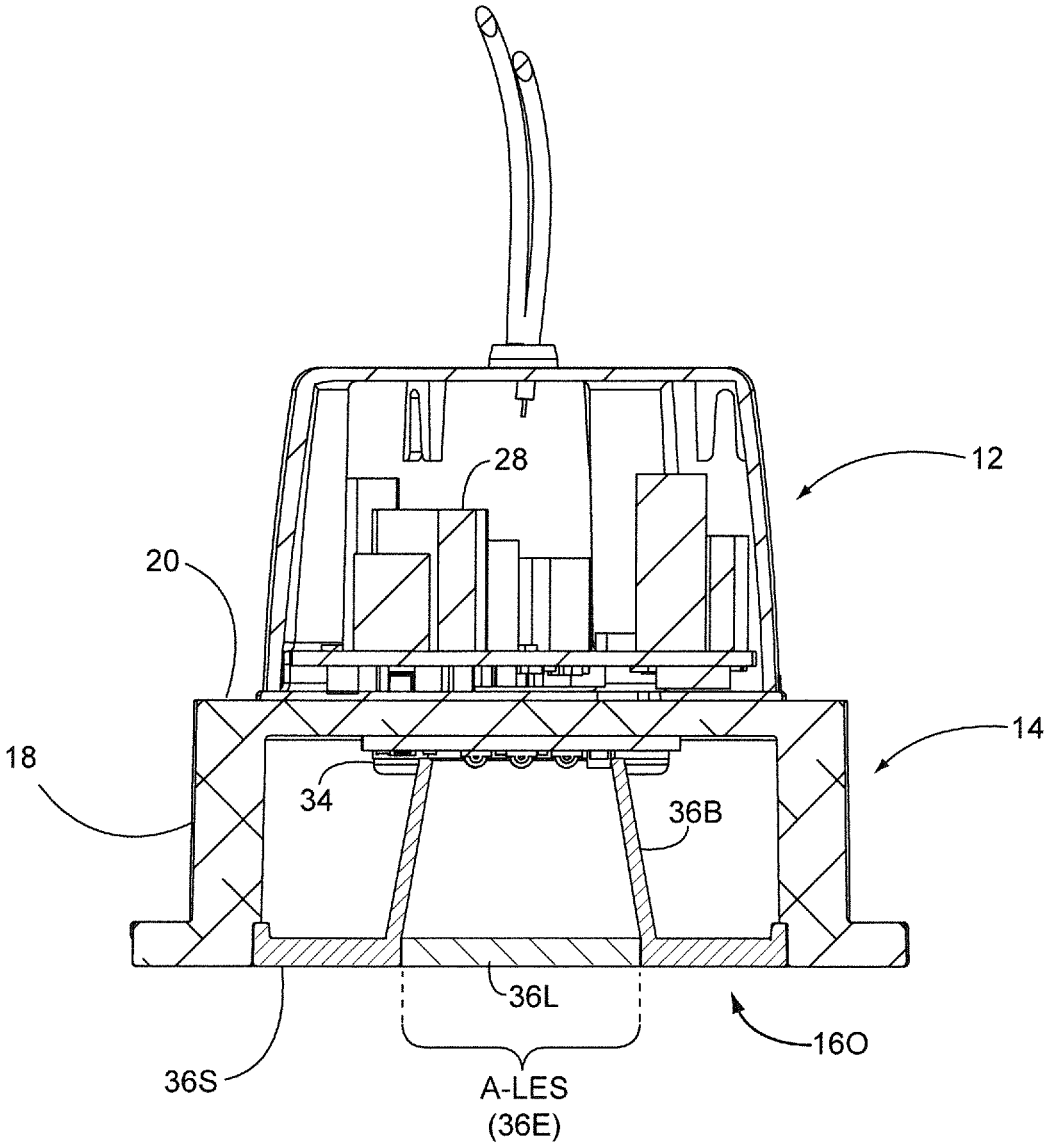
FIG. 9C is a cross-sectional view of a lighting fixture with an integrated lens assembly according to one embodiment of the disclosure.
Figure 9D:
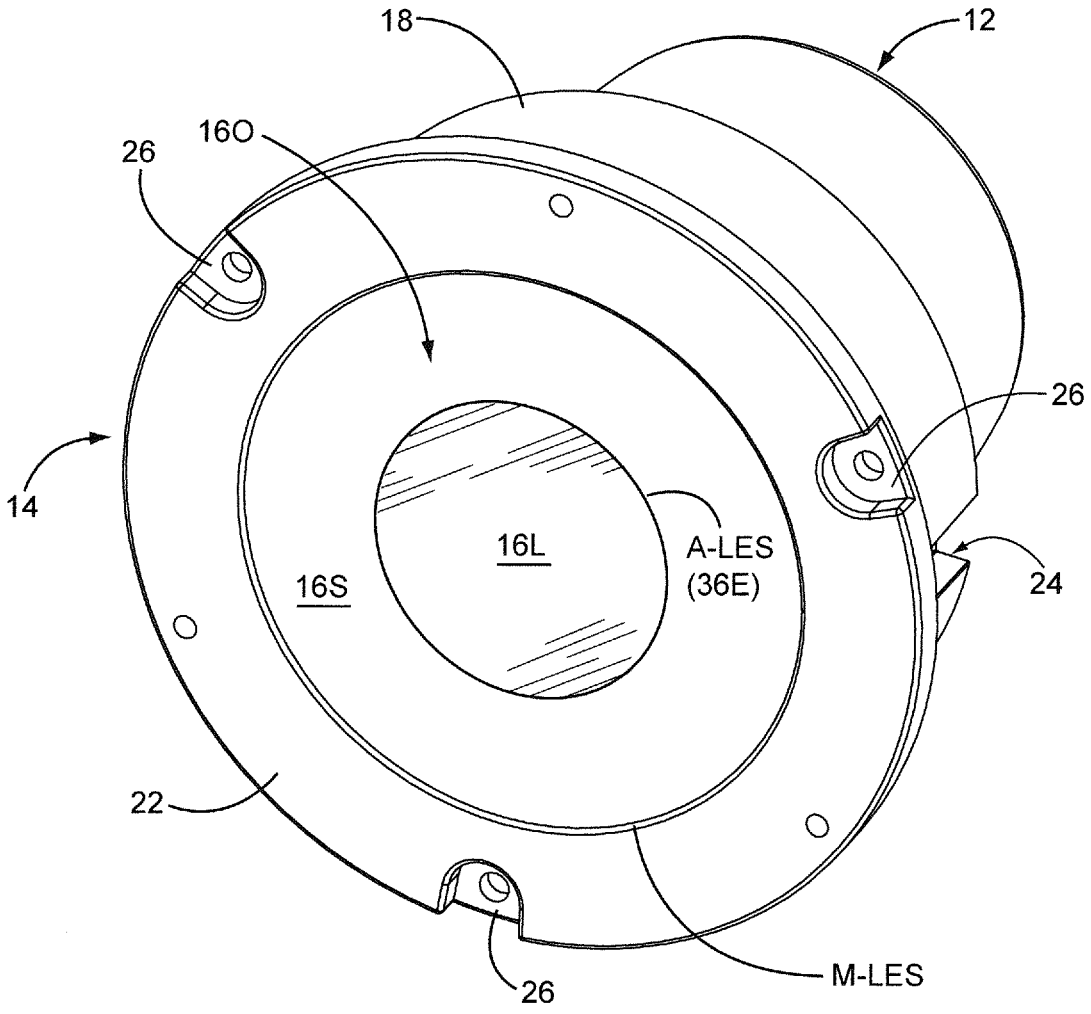
FIG. 9D is a front isometric view of the lighting fixture wherein the lens and the corresponding A-LES are illustrated when the using the integrated lens assembly of FIG. 9C.
Figure 10A:
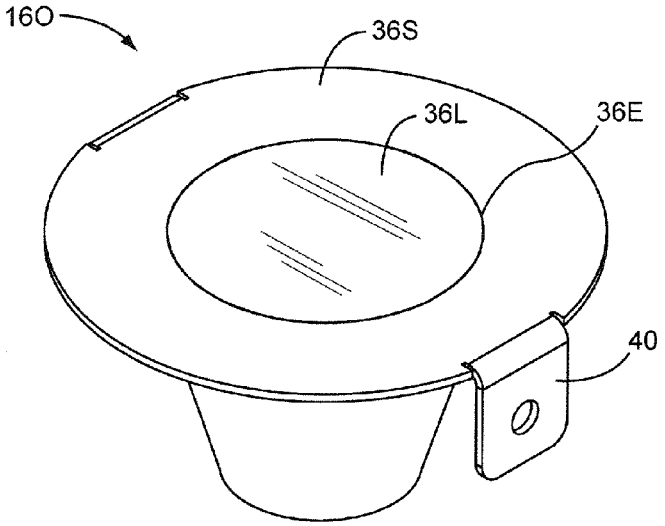
FIGS. 10A-10G are respective front isometric, rear isometric, rear plan, front plan, first side plan, second side plan, and cross-sectional views of the integrated lens assembly of FIG. 9C.
Figure 10B:
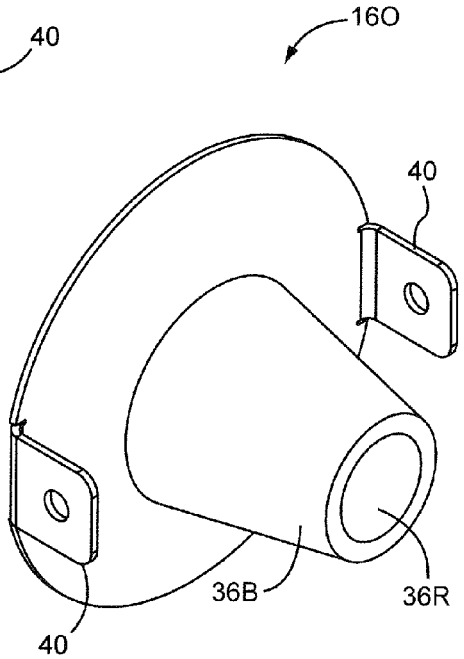
Figure 10C:
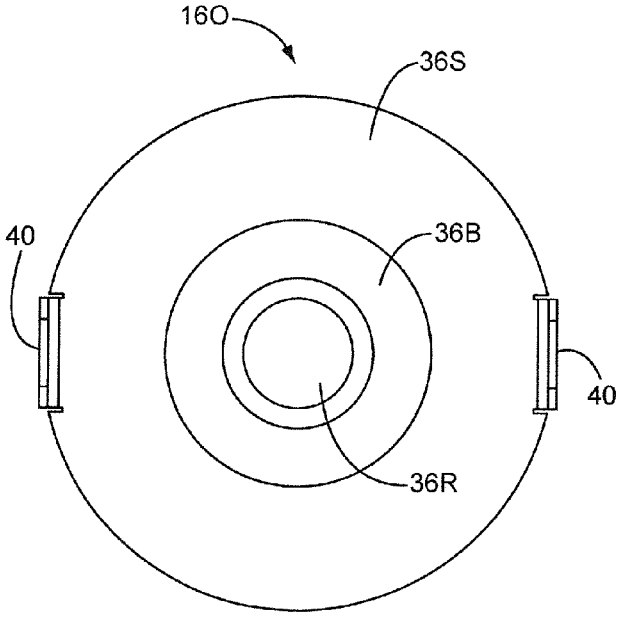
Figure 10D:
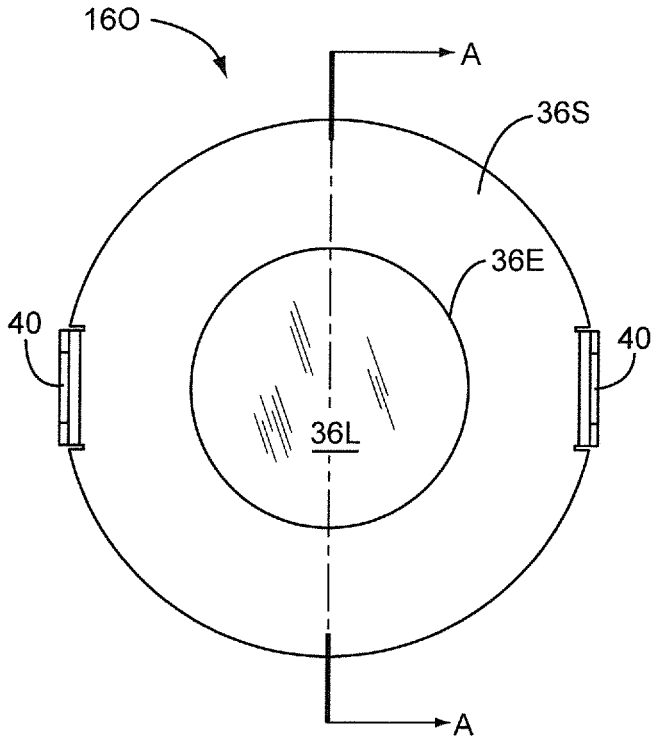
Figure 10E:
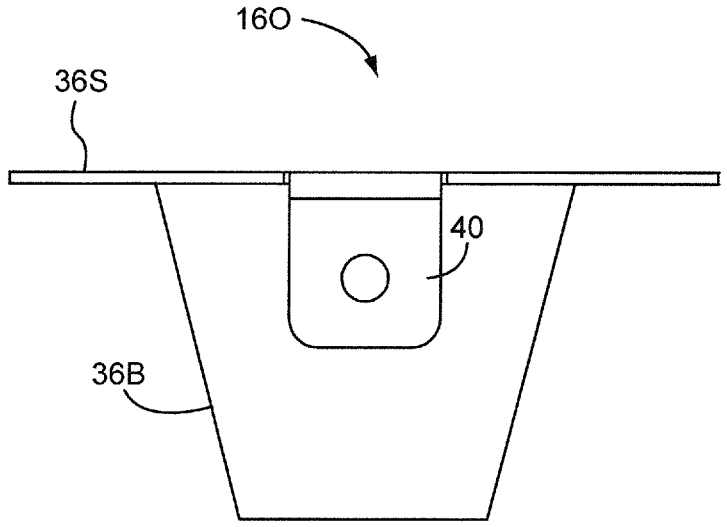
Figure 10F:
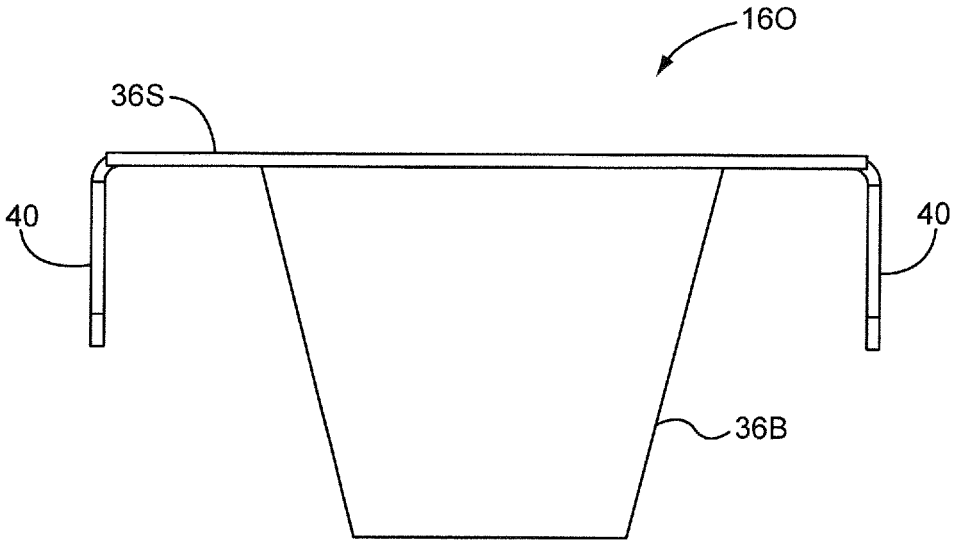
Figure 10G:
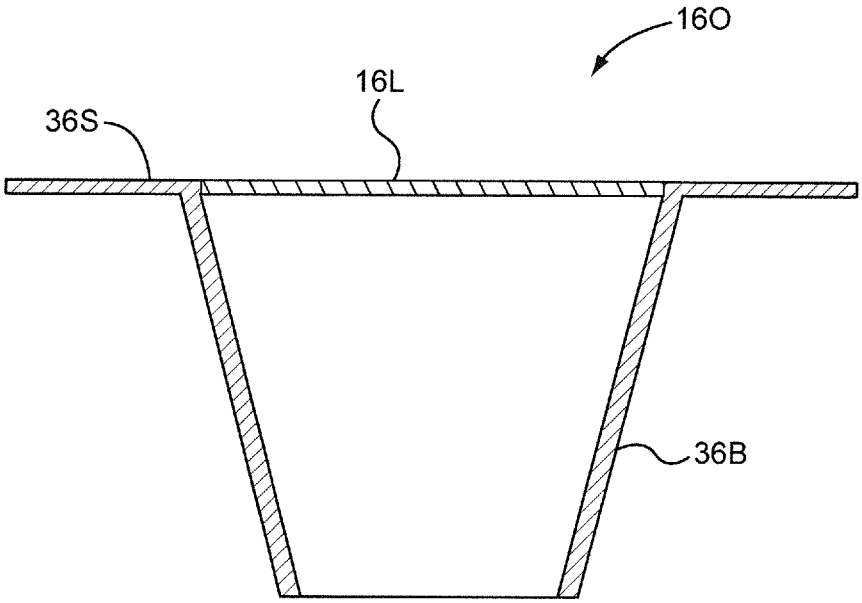

FIGS. 9C and 9D illustrate an embodiment wherein the lens assembly 16 and the internal optic 36 are effectively integrated to form a lens assembly with an integrated optic. This integrated piece is referred to as an integrated lens assembly 16O. FIG. 9C is a cross-sectional view and FIG. 9D is a front isometric view of the integrated lens assembly 16O installed in the lighting fixture 10. FIGS. 10A through 10G provide various isometric, plan, and cross-sectional views of the integrated lens assembly 16O. FIGS. 9C, 9D and 10A through 10G are referenced for the following description.

The integrated lens assembly 16O is primarily formed from the optic body 36B, shroud 36S, and a lens 36L. The shroud 36S is annular in this example and may include the rearward extending tabs 40 along the perimeter or other mechanism for connecting the integrated lens assembly 16O to the mounting structure 14 in the same or similar manner as described above with the lens assembly 16. As with the previous embodiment, the optic body 36B is conical and extends rearward from the larger, circular light emitting opening 36E and terminates at the smaller, circular light receiving opening 36R, which receives the array of LEDs 50.

The lens 36L can be integrally formed or mounted anywhere inside the optic body 36B. As illustrated, the lens 36L is provided at the light emitting opening 36E and has a front face that is substantially flush with the front face of the shroud 36S. The optic body 36B and the shroud 36S may be integrally formed, wherein the lens 36L is separately formed and then mounted inside the optic body 36B. Alternatively, the lens 36L, optic body 36B, and the shroud 36S, along with any mounting mechanism, may be integrally formed together from the same or different materials. In yet another embodiment, the optic body 36B, the shroud 36S, and the lens 36L are each independently formed and configured to connect to each other using a snap-fit technique or the like. The A-LES and the M-LES for this embodiment is the same as illustrated in FIG. 9A, wherein the A-LES corresponds to perimeter of the lens 36L.

In any of these embodiments, the optic body 36B, the shroud 36S, as well as the lens 36L may be formed from the same or different materials and have the same or different degree of transparency, translucency, or opaqueness. For the purposes herein, the term "degree of transparency" is defined as a relative term that can range from purely transparent to purely opaque with varying degrees of translucency therebetween. For example, the lens 36L may be formed from an acrylic, be translucent, and either coated or formed to provide the desired diffusion. Alternatively, the lens 36L could be a total internal reflector. The optic body 36B may be formed to include a relatively reflective interior surface, and the shroud 36S may be formed from a plastic or metal to provide a desired aesthetic or complement the light control properties provided by an exterior optic (not shown). For example, at least the exposed surface of the shroud 36S may match the appearance of the lens 36L, contrast with the appearance of the lens 36L, as well as have the same or different degree of transparency as the lens 36L. In essence, each part of the integrated lens assembly 16O or the internal optic 36 can be formed from the same or different components and have the same or different aesthetic.

Figure 11:
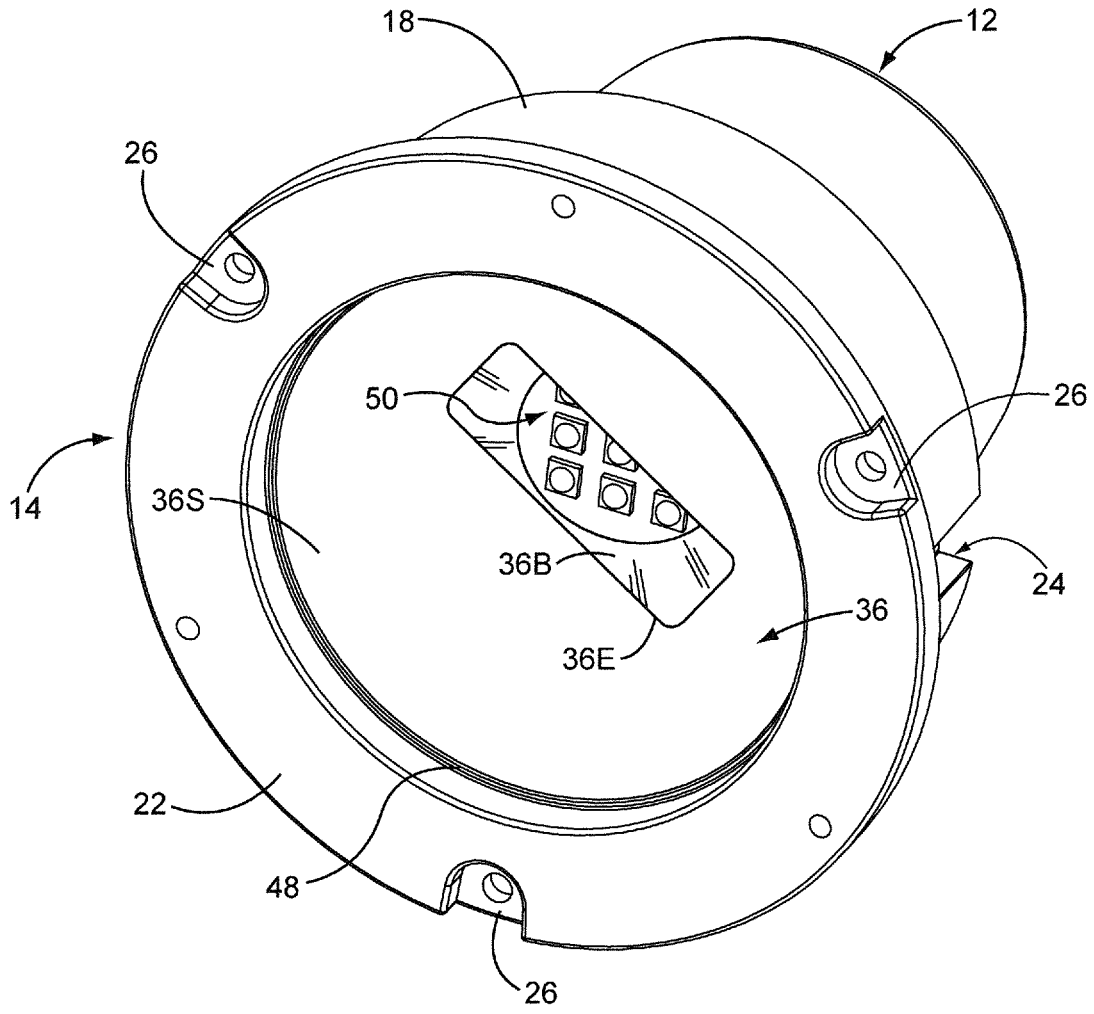
FIG. 11 is an isometric view of the front of lighting fixture without the lens assembly and with an internal optic, according to one embodiment of the disclosure.
Figure 12A:
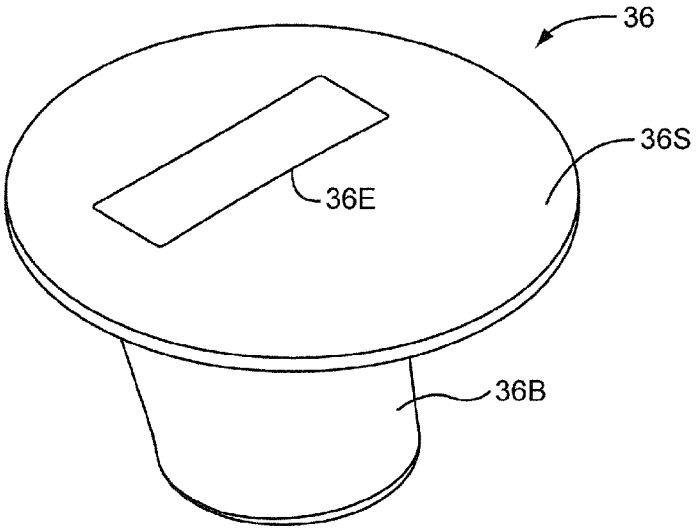
FIGS. 12A-12L are respective front isometric, rear isometric, front plan, rear plan, first side plan, second side plan, and six cross-sectional views of the internal optic of FIG. 11.
Figure 12B:
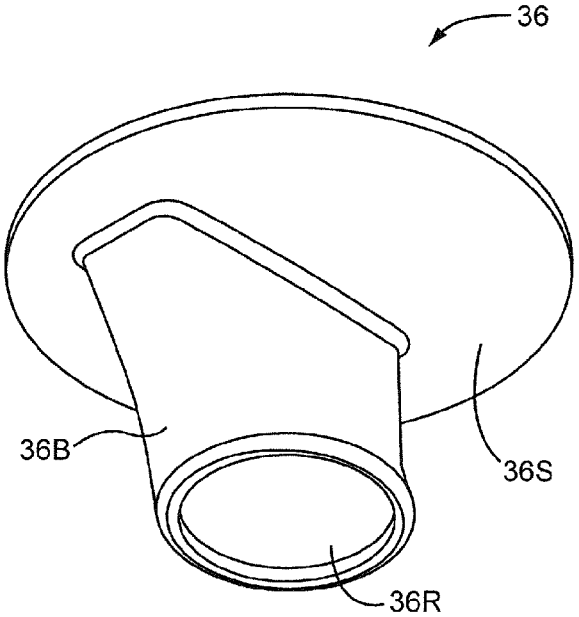
Figure 12C:
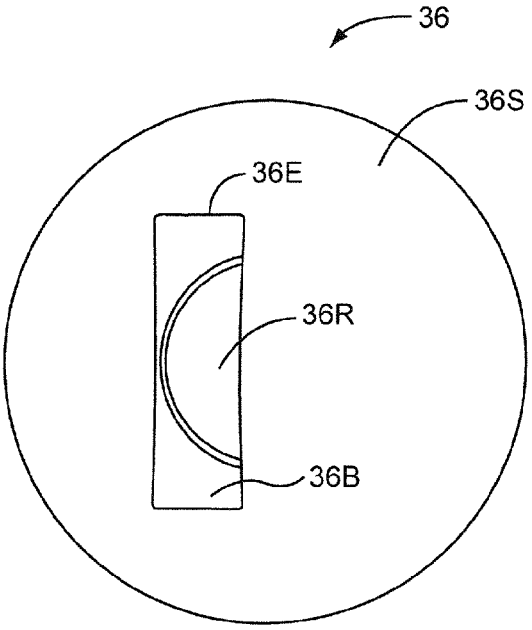
Figure 12D:
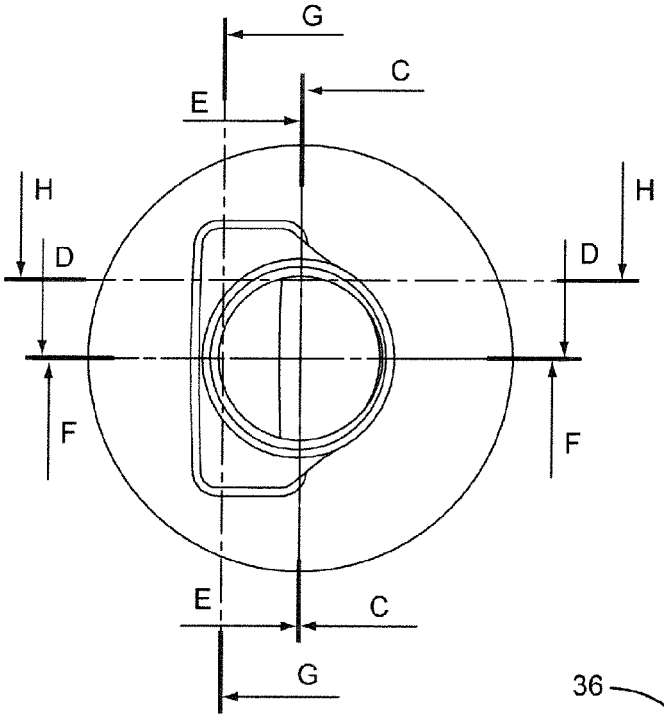
Figure 12E:
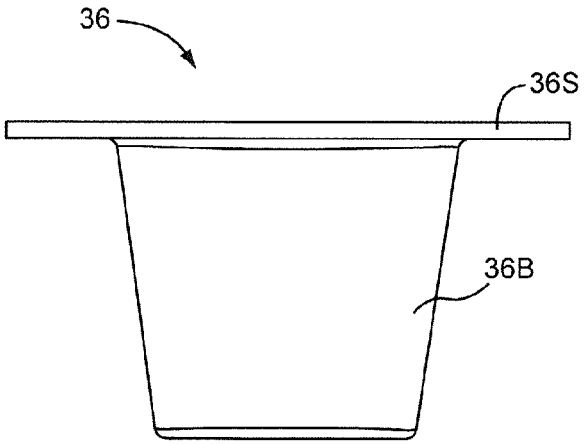
Figure 12F:
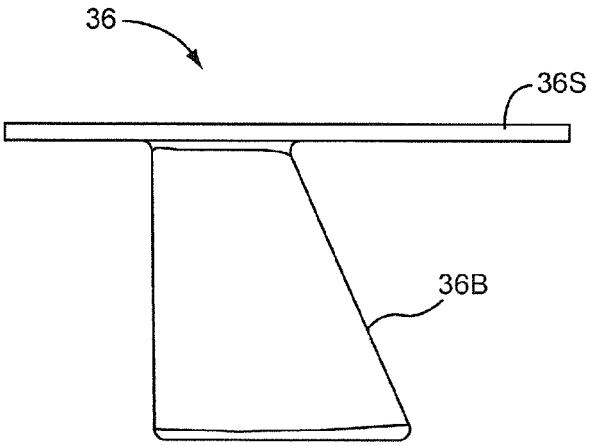
Figure 12G:
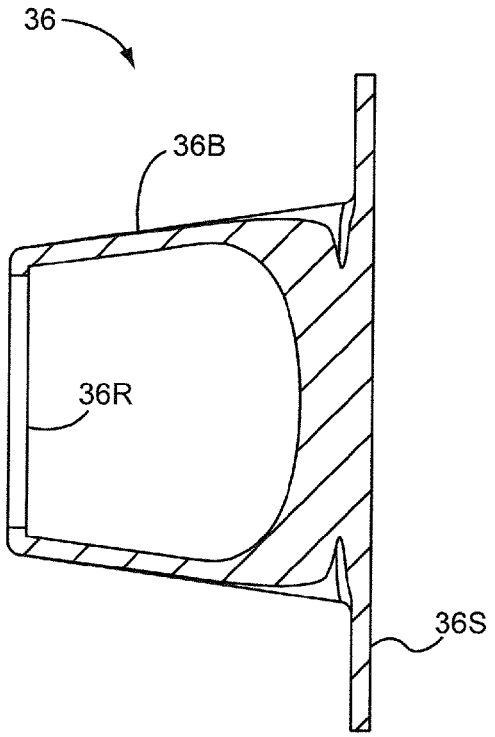
Figure 12H:
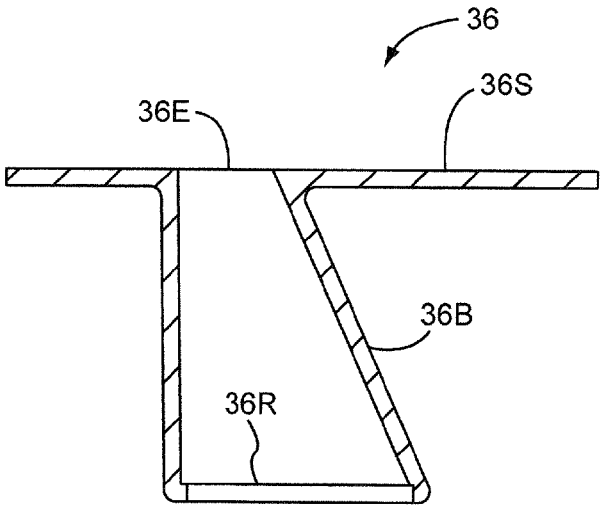
Figure 12I:
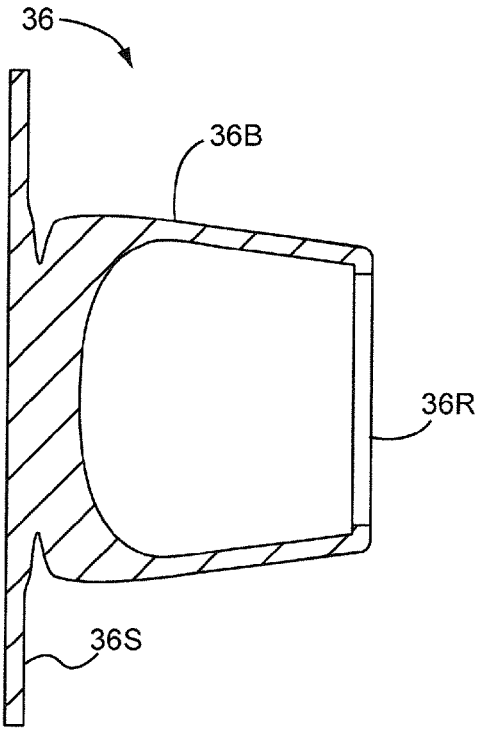
Figure 12J:
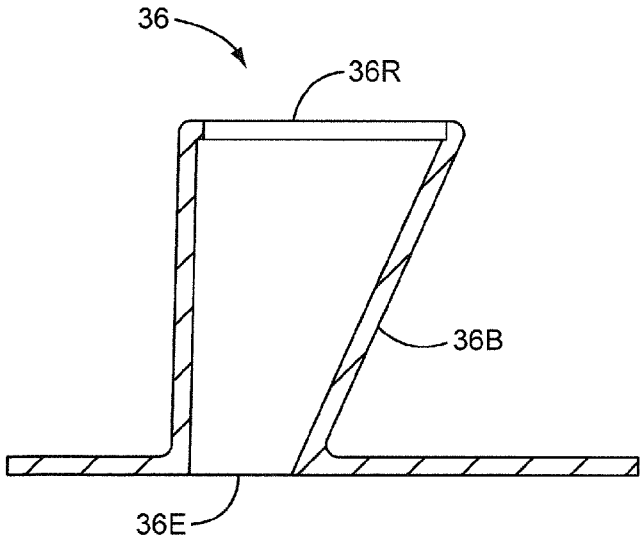
Figure 12K:
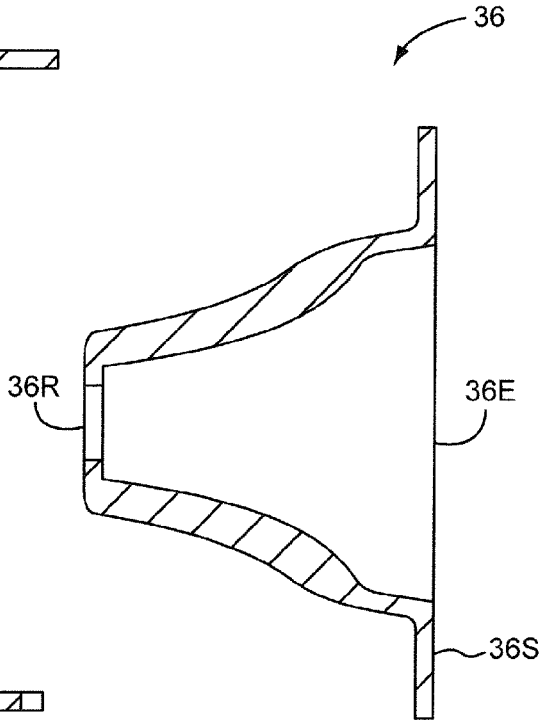
Figure 12L:
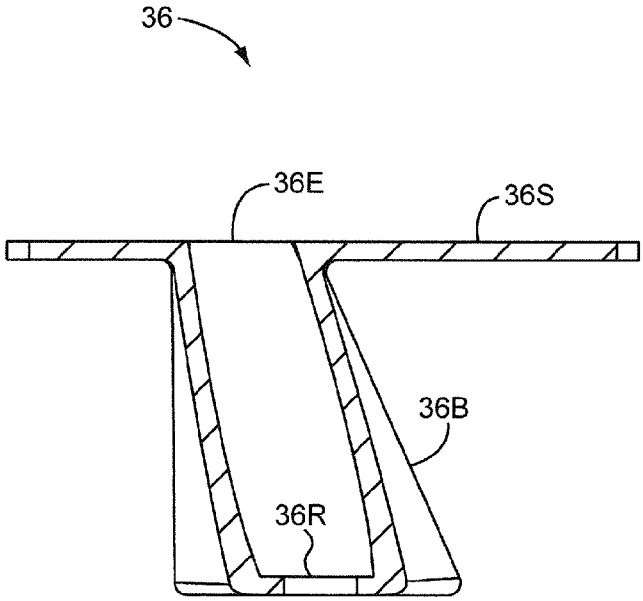

The A-LES need not be centered or correspond to the same shape as the front opening of the mounting structure 14. With reference to FIG. 11, the light emitting opening 36E in this embodiment is provided in the shroud 36S of the internal optic 36 and is an elongated rectangle that is shifted off of center. In this embodiment, the internal optic 36 is configured such that the light emitting opening 36E is substantially smaller than the opening at the front of the mounting structure 14. Details of the internal optic for this embodiment are illustrated in respective isometric, plan, and cross-sectional views of FIGS. 12A-12L. The internal optic 36 has a shroud 36S with the rectangular light emitting opening 36E located therein. The tubular optic body 36B extends rearward from the rectangular light emitting opening 36E and terminates at a circular light receiving opening 36R. This configuration is referred to as a rectangular bisymmetric shift, since the A-LES is substantially rectangular and symmetric about only one plane.

Figure 13:
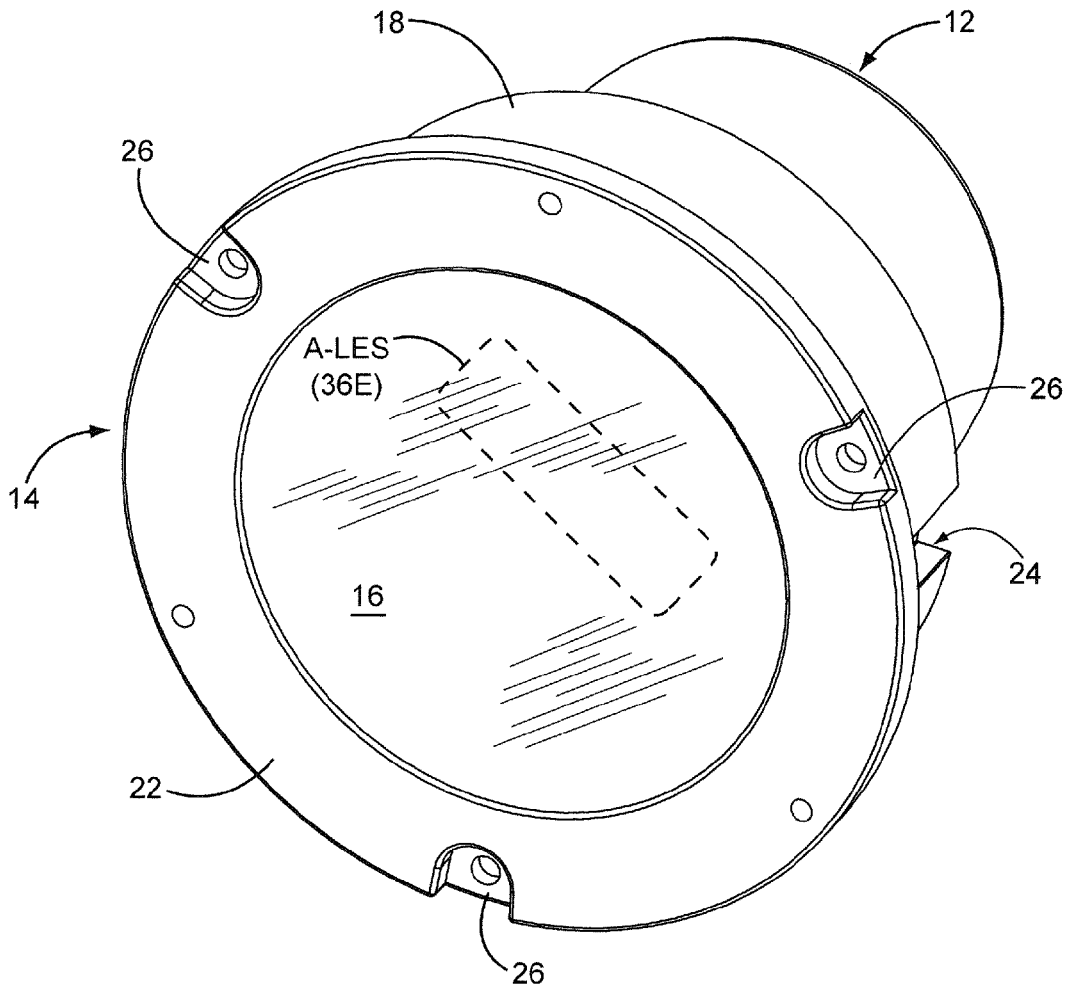
FIG. 13 is a front isometric view of the lighting fixture wherein the A-LES is illustrated when using the internal optic of FIG. 11.
Figure 14A:
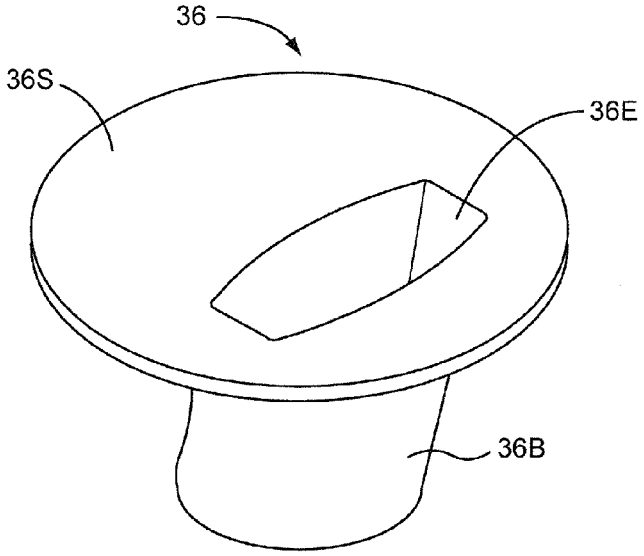
FIGS. 14A-14F are respective front isometric, rear isometric, front plan, rear plan, first side plan, and second side plan views of another embodiment of the internal optic.
Figure 14B:
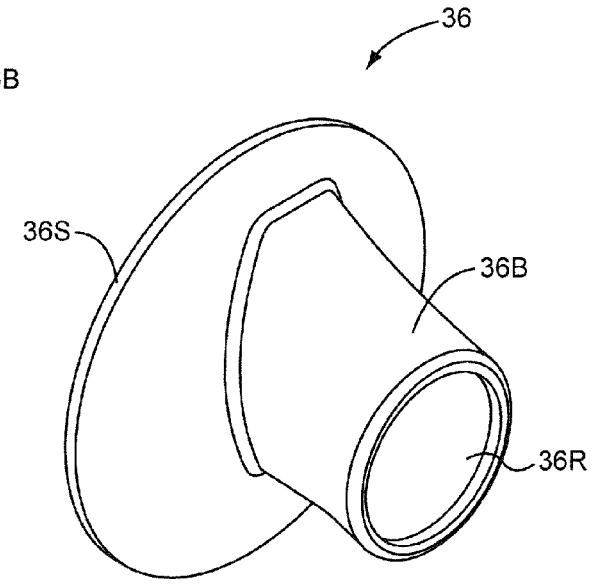
Figure 14C:
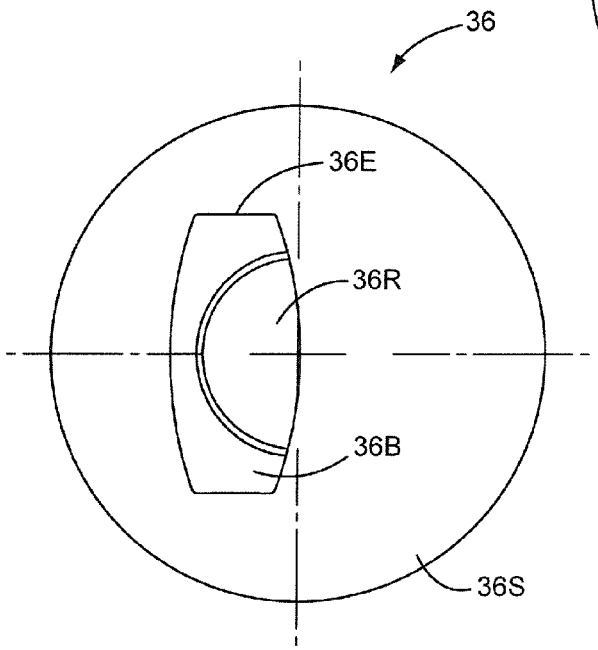
Figure 14D:
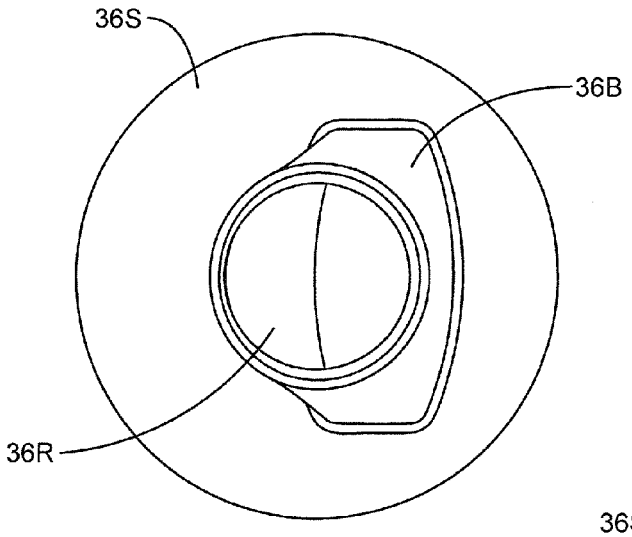
Figure 14E:
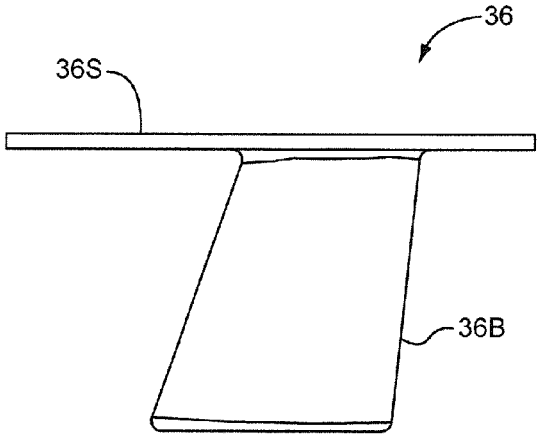
Figure 14F:
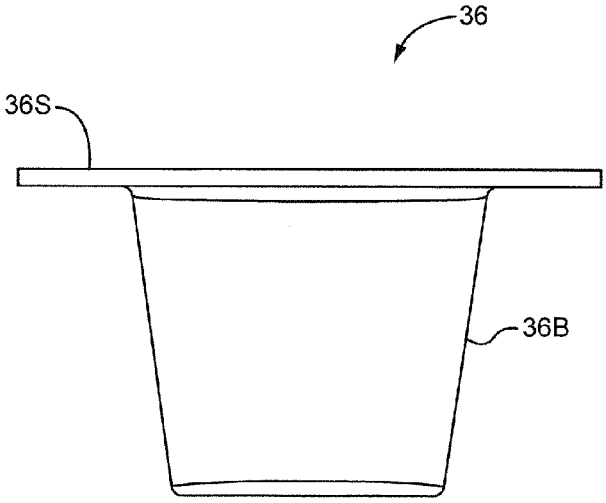
Figure 15A:
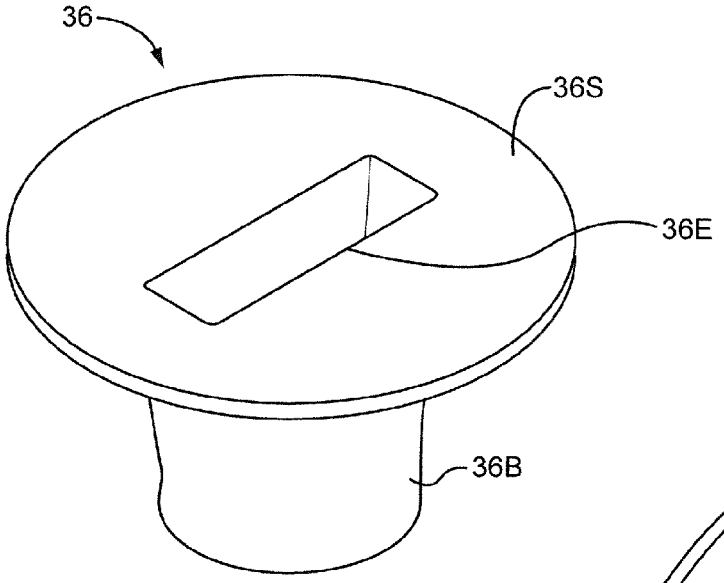
FIGS. 15A-15F are respective front isometric, rear isometric, front plan, rear plan, first side plan, and second side plan views of another embodiment of the internal optic.
Figure 15B:
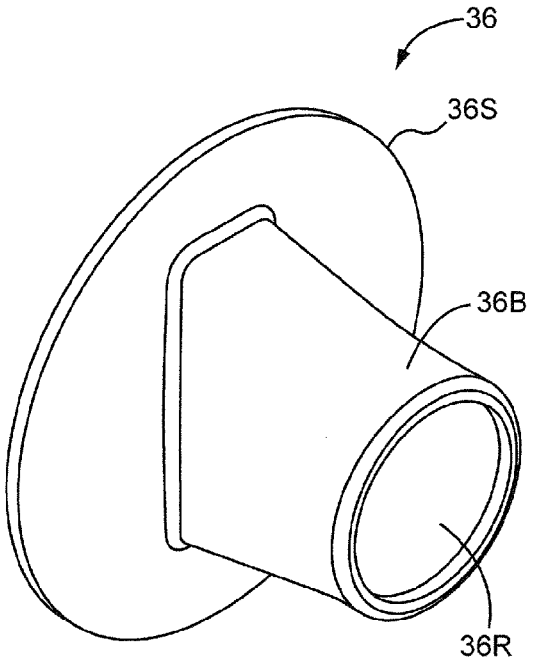
Figure 15C:
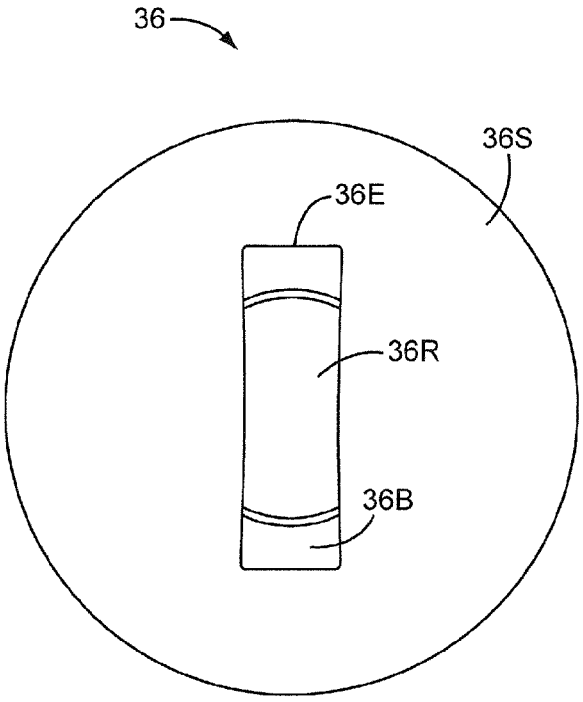
Figure 15D:
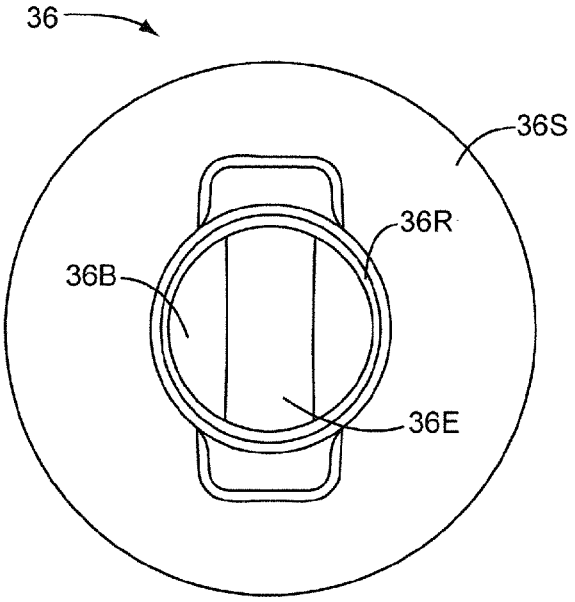
Figure 15E:
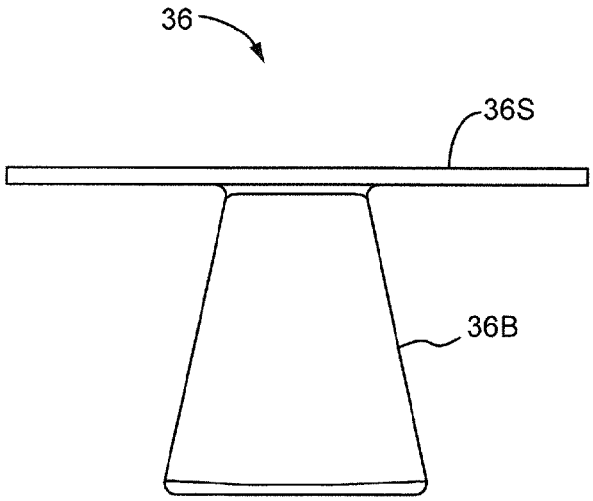
Figure 15F:
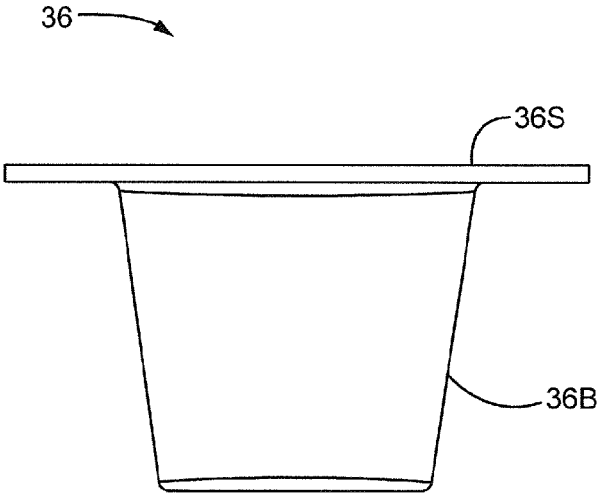

FIG. 13 depicts the lighting fixture 10 with the internal optic 36 of FIG. 11 and the lens assembly 16 installed. Again, the A-LES is identified by the dashed line and corresponds to the light emitting opening 36E of the internal optic 36. The A-LES is substantially smaller than the M-LES, which corresponds to the entirety of the front surface of the lens assembly 16 in this embodiment. While smaller in area, the A-LES also has a substantially different, rectangular shape than the circular M-LES and is not centered within the M-LES or lens assembly 16.

FIGS. 14A-14F are various isometric and plan views of an alternative embodiment of the internal optic 36. The internal optic 36 in this embodiment has a shroud 36S with a substantially rectangular light emitting opening 36E located therein. The light emitting opening 36E is not located in the center of the shroud 36S. The shorter sides of the rectangular light emitting opening 36E are linear, while the longer sides of the rectangular light emitting opening 36E are curved, such that they are concave relative to the inside of the light emitting opening 36E. The tubular optic body 36B extends rearward from the light emitting opening 36E and terminates at a circular light receiving opening 36R. This configuration is referred to as a modified rectangular bisymmetric shift, since the resultant A-LES is generally, but not exactly, rectangular and symmetric about only one plane. When used with the lens assembly 16, the A-LES on the lens assembly 16 will correspond to the light emitting opening 36E.

FIGS. 15A-15F are various isometric and plan views of an alternative embodiment of the internal optic 36. The internal optic 36 in this embodiment has a shroud 36S with a rectangular light emitting opening 36E located therein. The light emitting opening 36E is located in the center of the shroud 36S. The tubular optic body 36B extends rearward from the light emitting opening 36E and terminates at a circular light receiving opening 36R. This configuration is referred to as a rectangular symmetric shift, since the resultant A-LES is rectangular and symmetric about two perpendicular planes. When used with the lens assembly 16, the A-LES on the lens assembly 16 will correspond to the light emitting opening 36E.

FIGS. 16A-16F are various isometric and plan views of an alternative embodiment of the internal optic 36. The optic body 36B takes on a rectangular, pyramidal shape. The internal optic 36 in this embodiment has a shroud 36S with a substantially rectangular light emitting opening 36E located therein. The longer sides of the rectangular light emitting opening 36E are linear, while the shorter sides of the rectangular light emitting opening 36E are curved, such that they are concave relative to the inside of the light emitting opening 36E. The light emitting opening 36E is located in the center of the shroud 36S. The hollow optic body 36B extends rearward from a larger rectangular light emitting opening 36E and terminates at a smaller rectangular light receiving opening 36R. In this embodiment, the intersections of adjacent sidewalls of the optic body 36B and the intersections of each sidewall with the shroud 36S are beveled in a concave (as shown), convex, or linear fashion. Further, the rear edges of the four sidewalls of the optic body 36B are beveled inward to form the light receiving opening 36R. Avoiding 90-degree angles at these various intersections may improve the efficiency of the mixing chamber, which is substantially defined by the interior cavity of the optic body 36B.

Figure 16A:
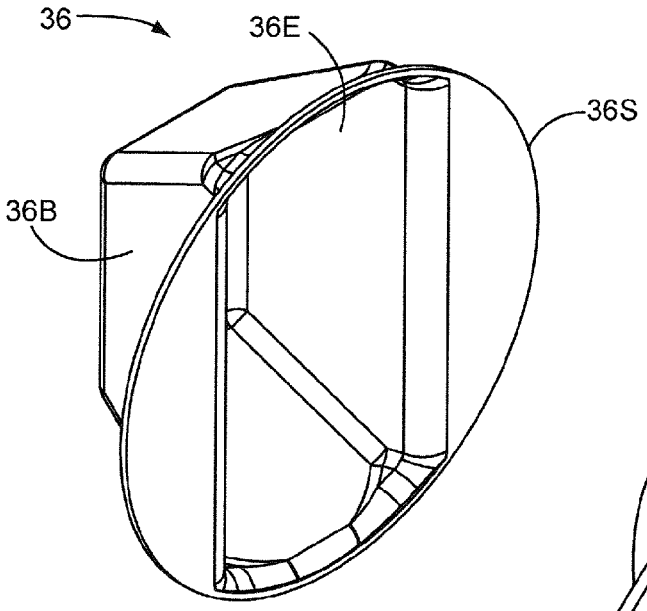
FIGS. 16A-16F are respective front isometric, rear isometric, front plan, rear plan, first side plan, and second side plan views of another embodiment of the internal optic.
Figure 16B:
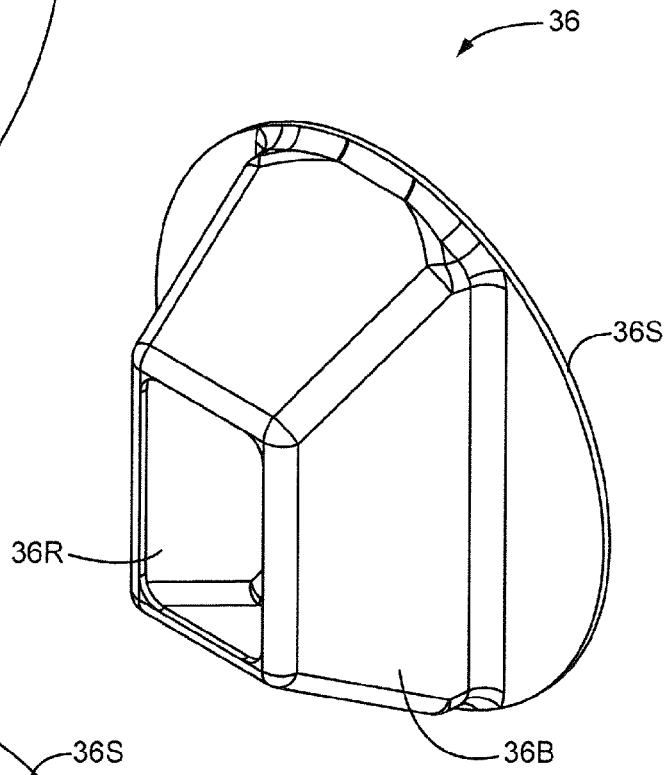
Figure 16C:
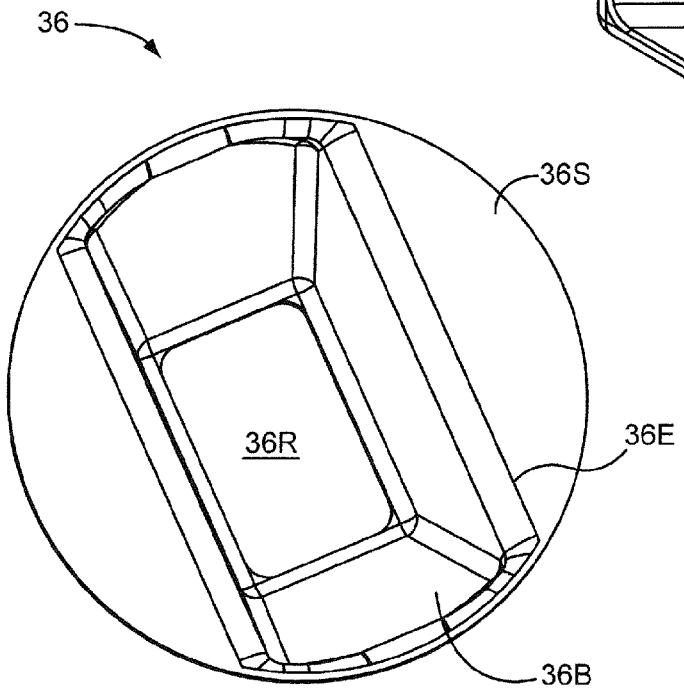
Figure 16D:
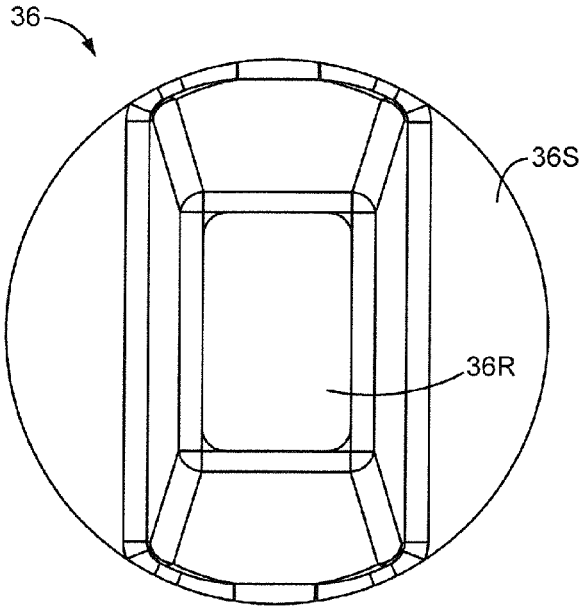
Figure 16E:
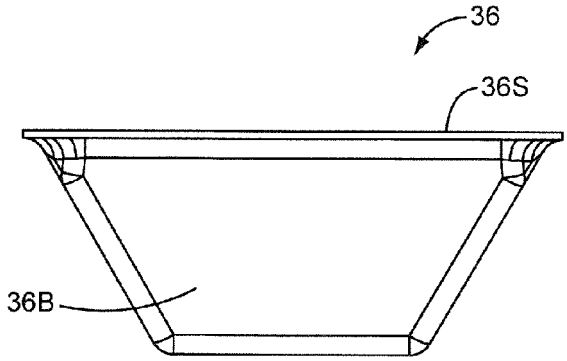
Figure 16F:
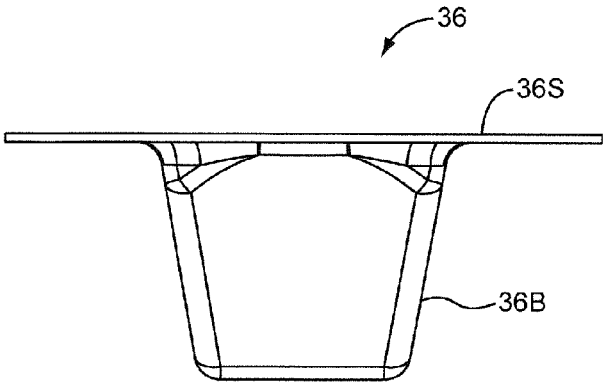
Figure 16G:
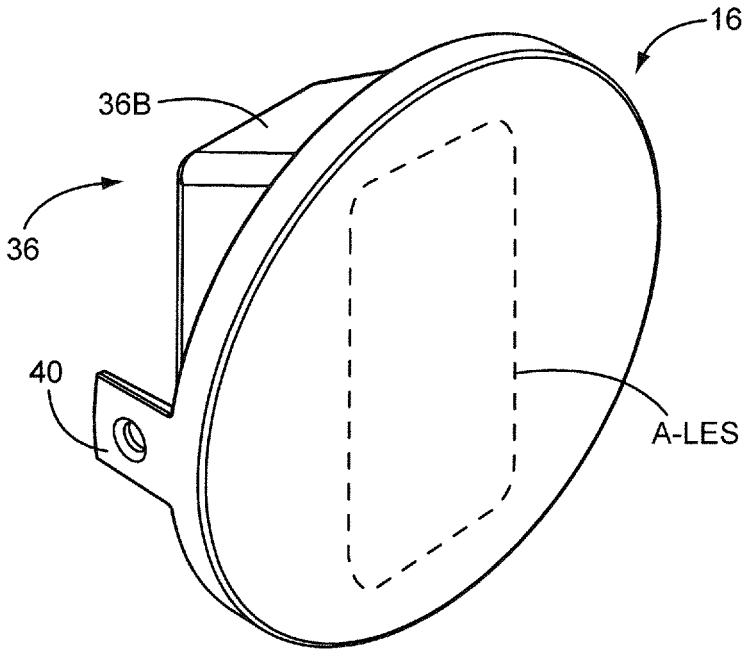
FIGS. 16G and 16H are front isometric and rear isometric views of the internal optic of FIGS. 16A-16F recessed in the rear of the lens assembly.
Figure 16H:
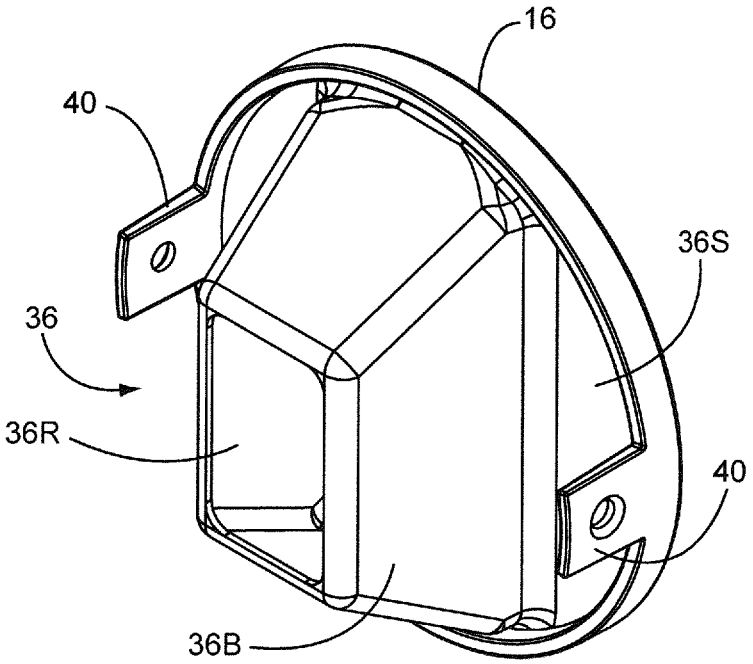

FIGS. 16G and 16H illustrate front and rear isometric views of the internal optic 36 residing in position within the lens assembly 16. As shown, a rearward-extending rim that runs around the perimeter of the lens assembly 16 receives the shroud 36S. The rest of the lighting fixture 10 is not illustrated. When used with the lens assembly 16, the rectangular A-LES on the lens assembly 16 will correspond to the rectangular light emitting opening 36E, as illustrated in the front isometric view of FIG. 16G.

FIGS. 17A-17E are various isometric and plan views of an alternative embodiment of the internal optic 36. The optic body 36B takes on a substantially square, pyramidal shape. The internal optic 36 in this embodiment has a shroud 36S with a substantially square light emitting opening 36E located therein. The sides of the square light emitting opening 36E are linear. The light emitting opening 36E is located in the center of the shroud 36S. The hollow optic body 36B extends rearward from a larger, square light emitting opening 36E and terminates at a smaller, square light receiving opening 36R. In this embodiment, the intersections of adjacent sidewalls of the optic body 36B and the intersections of each sidewall with the shroud 36S are beveled in a convex (as shown), concave, or linear fashion. Further, the rear edges the four sidewalls of the optic body 36B turn inward to form the light receiving opening 36R. Avoiding 90-degree angles at these various intersections may improve the efficiency of the mixing chamber, which is substantially defined by the interior cavity of the optic body 36B.

Figure 17A:
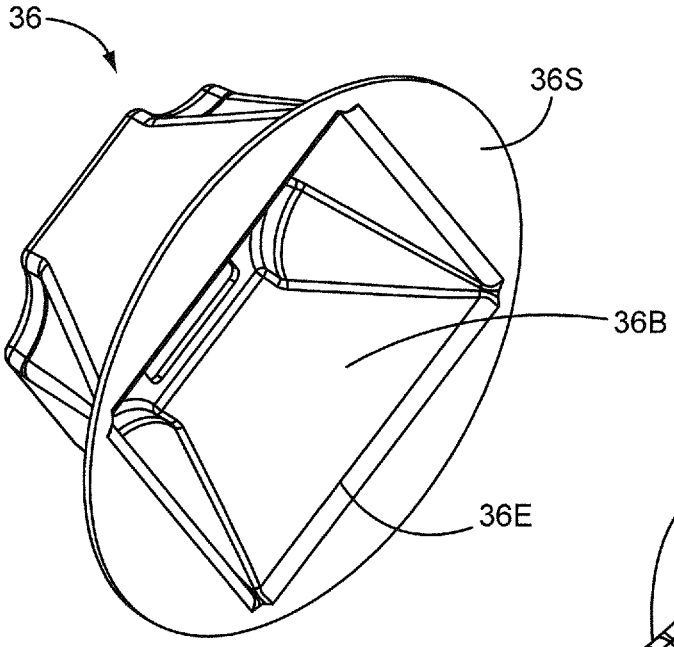
FIGS. 17A-17E are respective front isometric, rear isometric, front plan, rear plan, and side plan views of another embodiment of the internal optic.
Figure 17B:
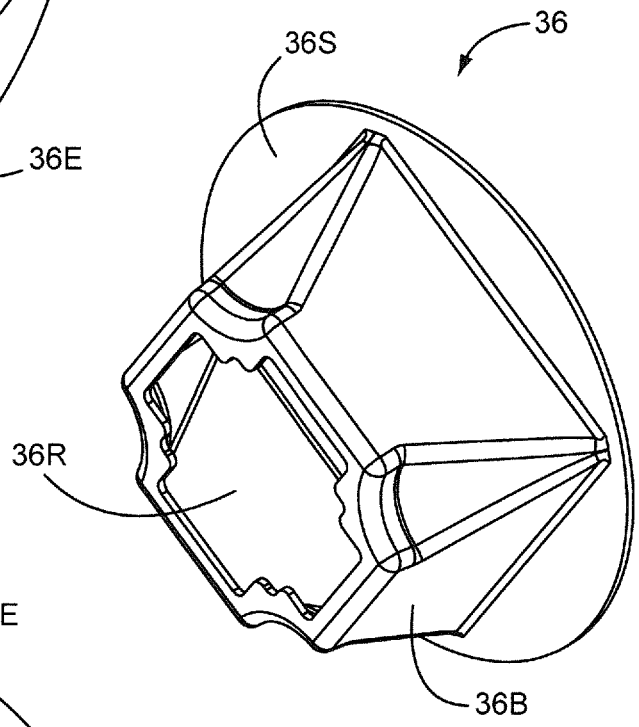
Figure 17C:
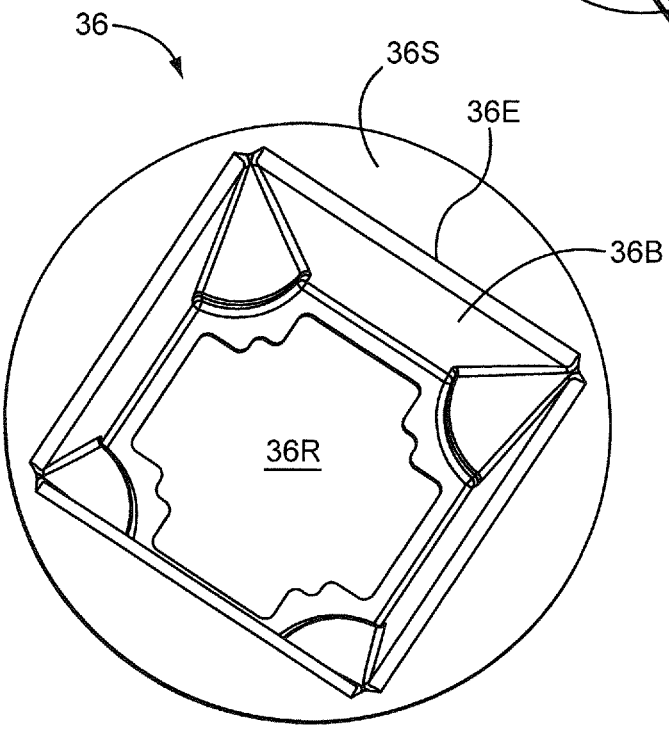
Figure 17D:
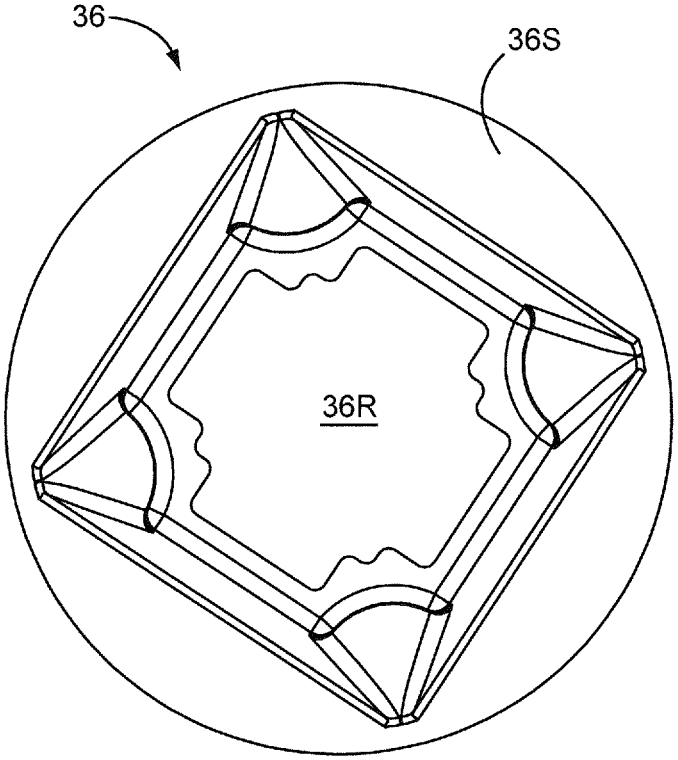
Figure 17E:
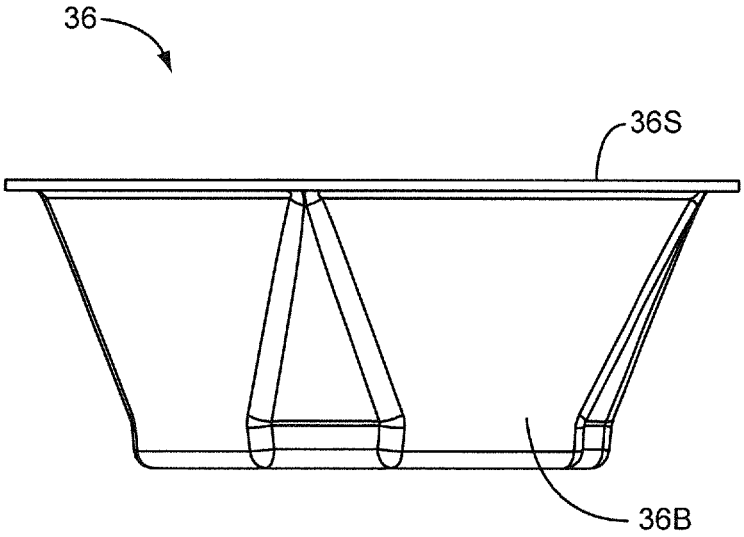
Figure 17F:
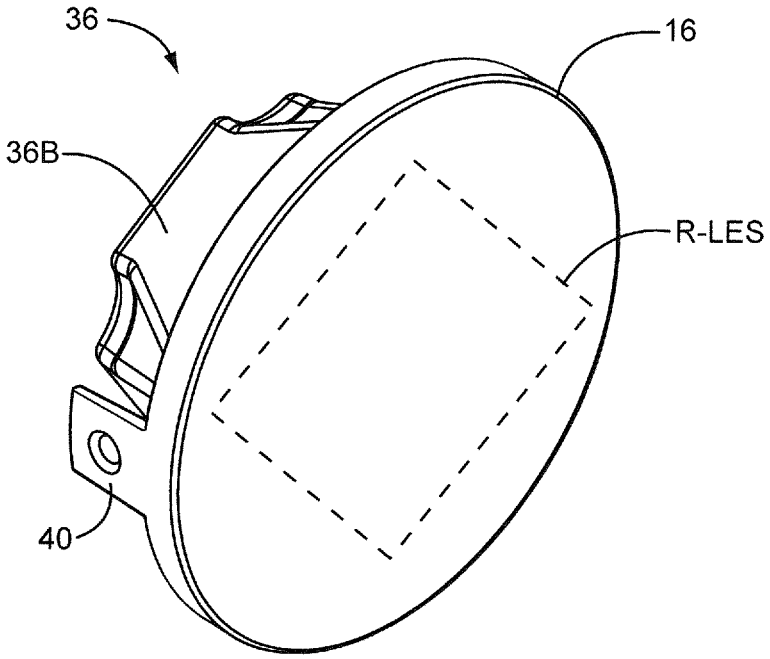
FIGS. 17F and 17G are front isometric and rear isometric views of the internal optic of FIGS. 17A-17E recessed in the rear of the lens assembly.
Figure 17G:
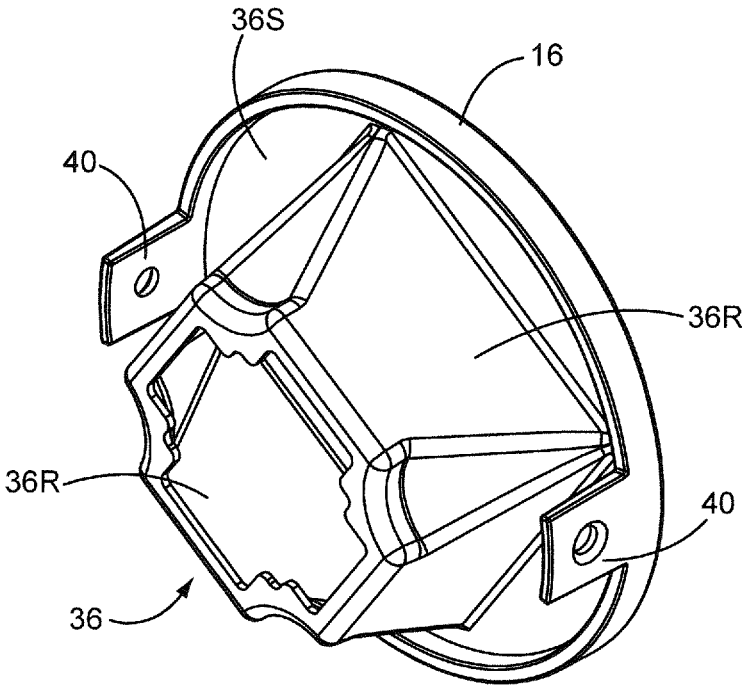

FIGS. 17F and 17G illustrate front and rear isometric views of the internal optic 36 residing in position within the lens assembly 16. The rest of the lighting fixture 10 is not illustrated. When used with the lens assembly 16, the square A-LES on the lens assembly 16 will correspond to the square light emitting opening 36E, as illustrated in the front isometric view of FIG. 17F.

FIGS. 18A-18E are various isometric and plan views of an alternative embodiment of the internal optic 36. The optic body 36B takes on a semi-conical shape. The internal optic 36 in this embodiment has a shroud 36S with a semi-circular light emitting opening 36E located therein. The curved portion of the light emitting opening 36E runs along the perimeter of the shroud 36S, while the linear portion of the light emitting opening 36E substantially bisects the shroud 36S. The hollow optic body 36B extends rearward from the light emitting opening 36E and terminates at a smaller, semi-circular light receiving opening 36R.

Figure 18A:
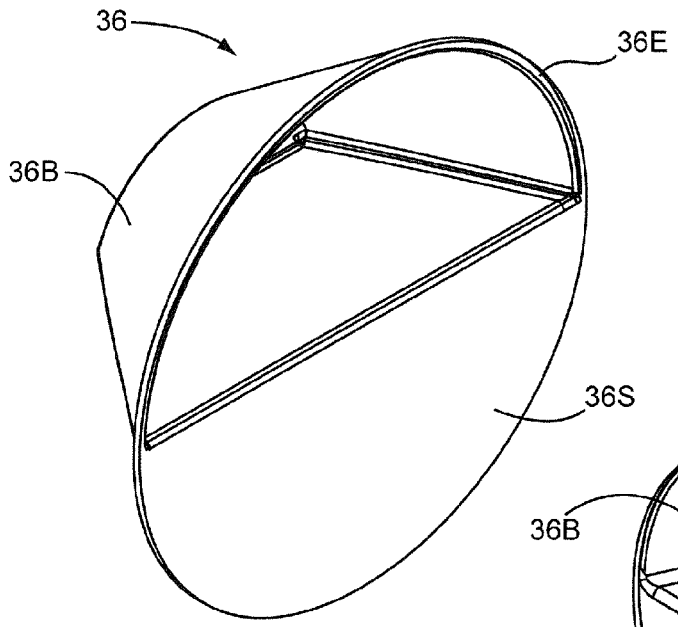
FIGS. 18A-18E are respective front isometric, rear isometric, front plan, rear plan, and side plan views of another embodiment of the internal optic.
Figure 18B:
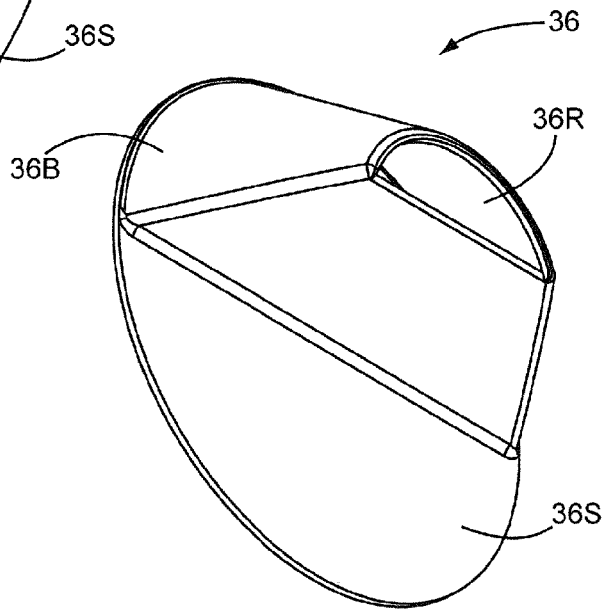
Figure 18C:
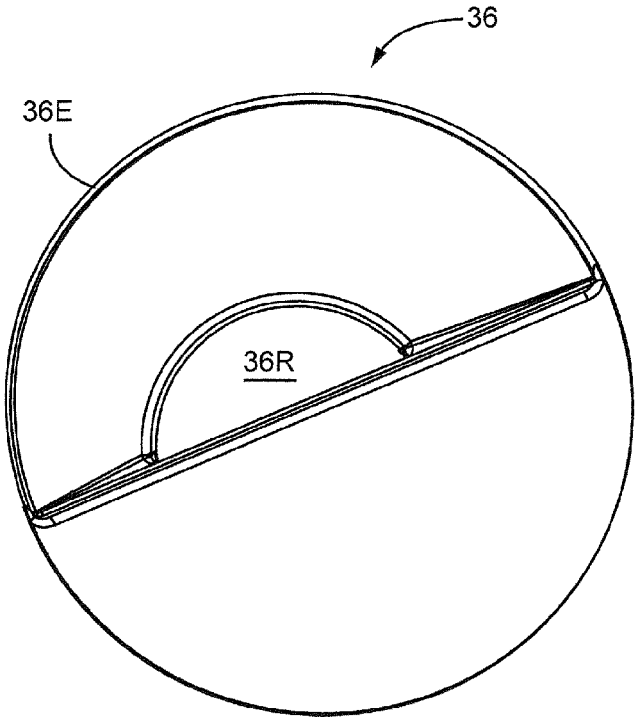
Figure 18D:
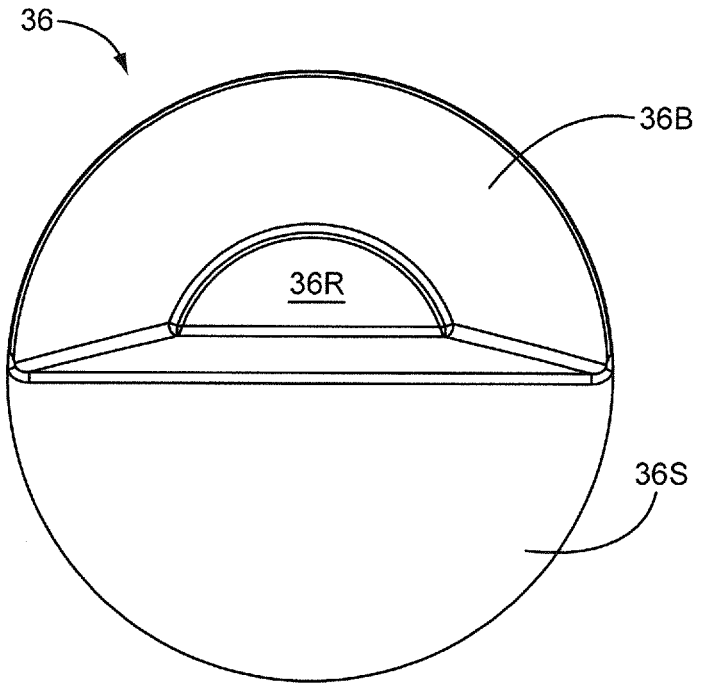
Figure 18E:
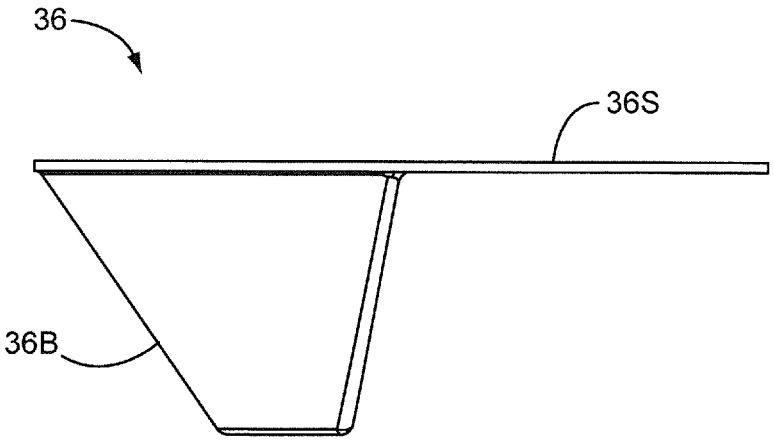
Figure 18F:
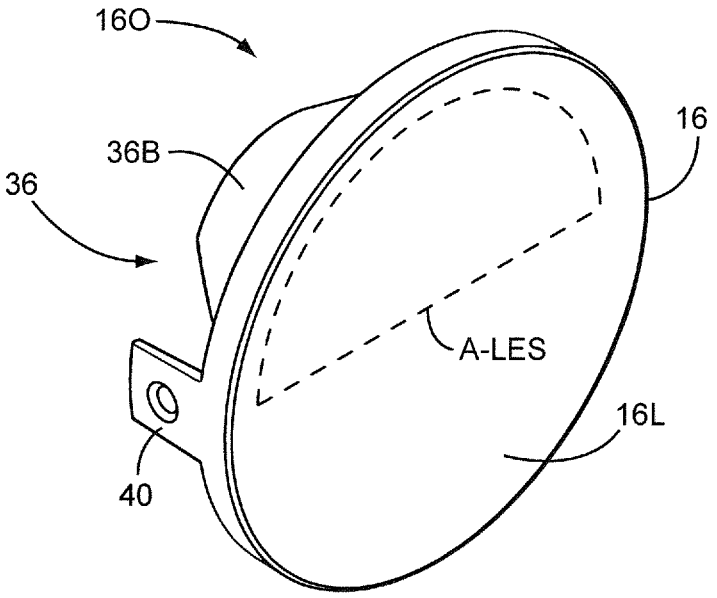
FIGS. 18F and 18G are front isometric and rear isometric views of the internal optic of FIGS. 18A-18E recessed in the rear of the lens assembly.
Figure 18G:
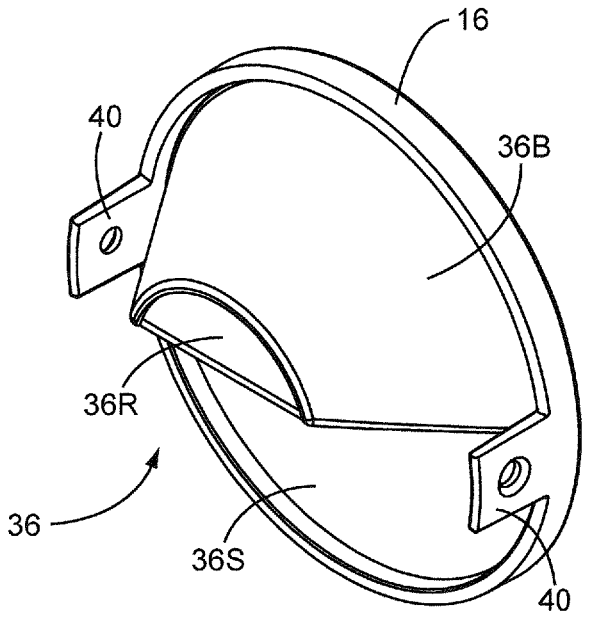
Figure 19A:
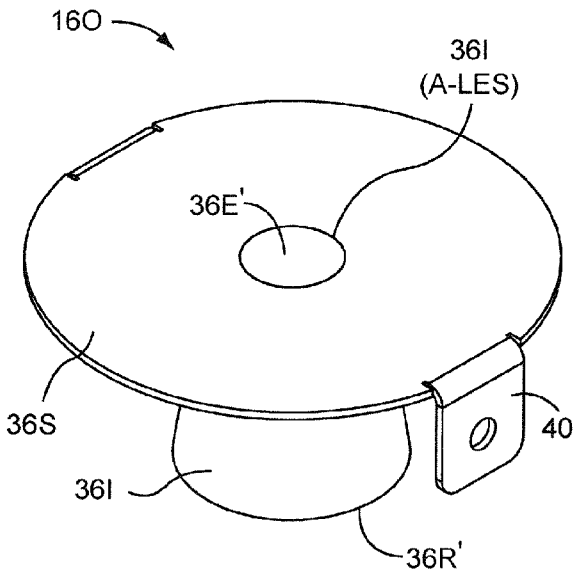
FIGS. 19A-19E are respective front isometric, rear isometric, rear plan, side plan, and cross-sectional views of an integrated lens assembly with a TIR.
Figure 19B:
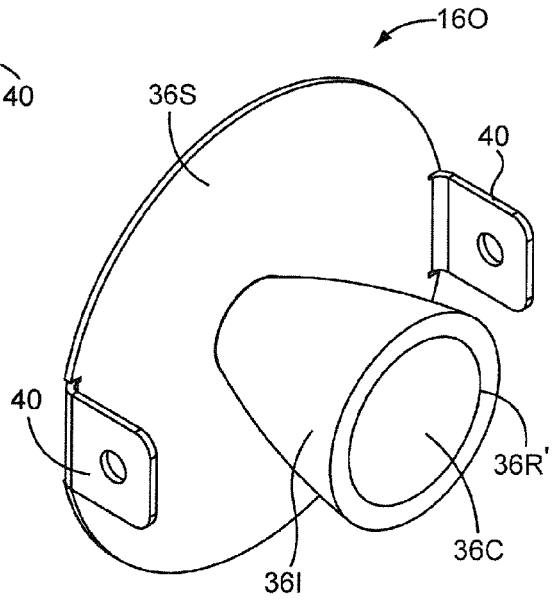
Figure 19C:
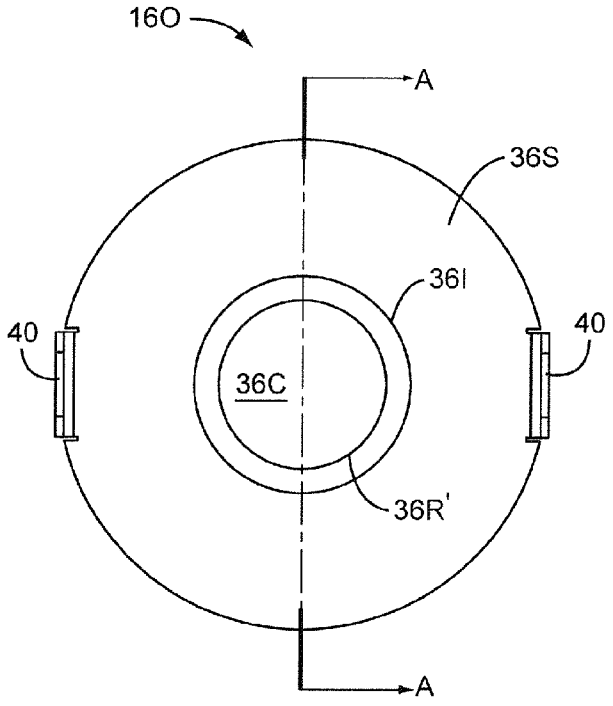
Figure 19D:
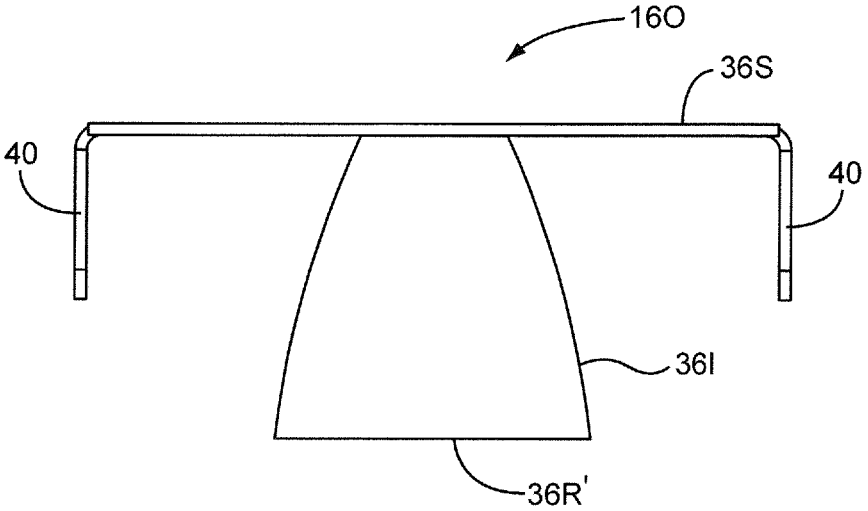
Figure 19E:
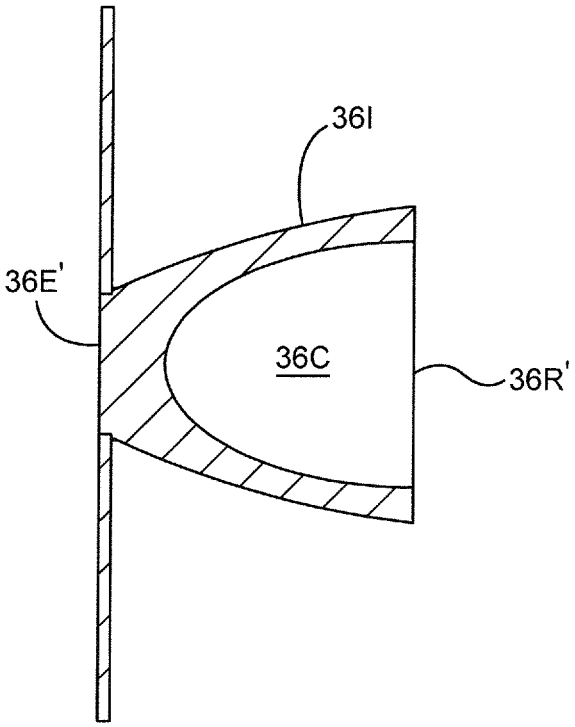
Figure 20A:
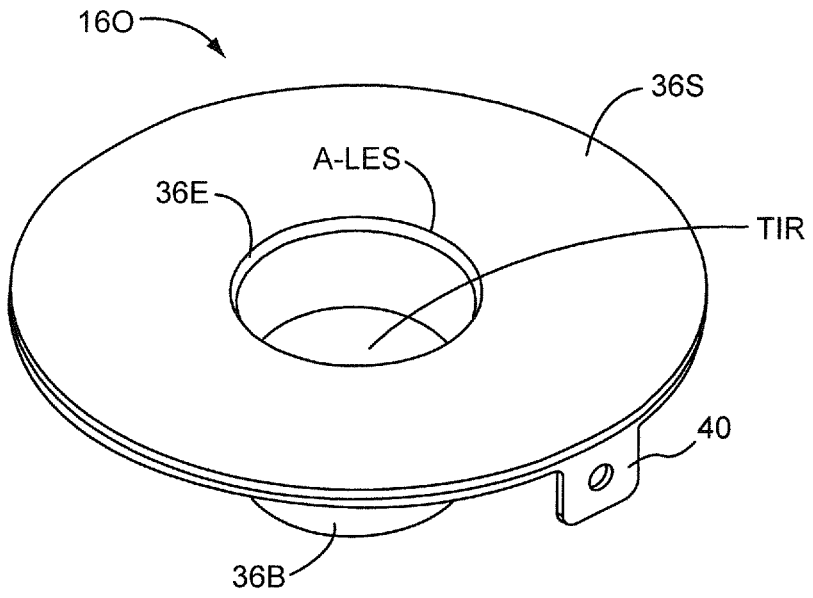
FIGS. 20A-20F are respective front isometric, rear isometric, front plan, rear plan, first side plan, and second side plan views of another embodiment of the internal optic.
Figure 20B:
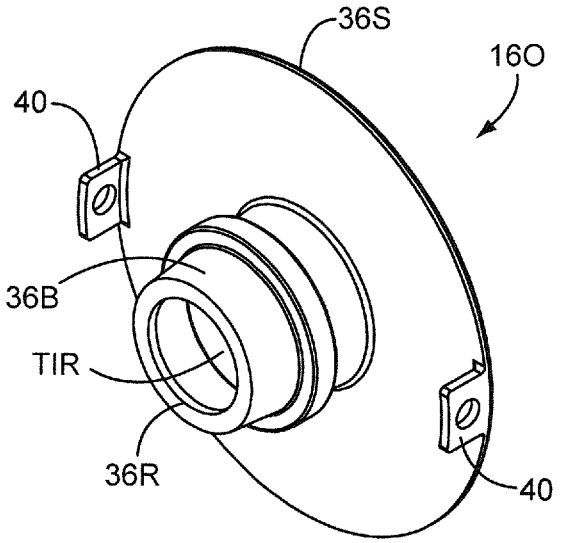
Figure 20C:
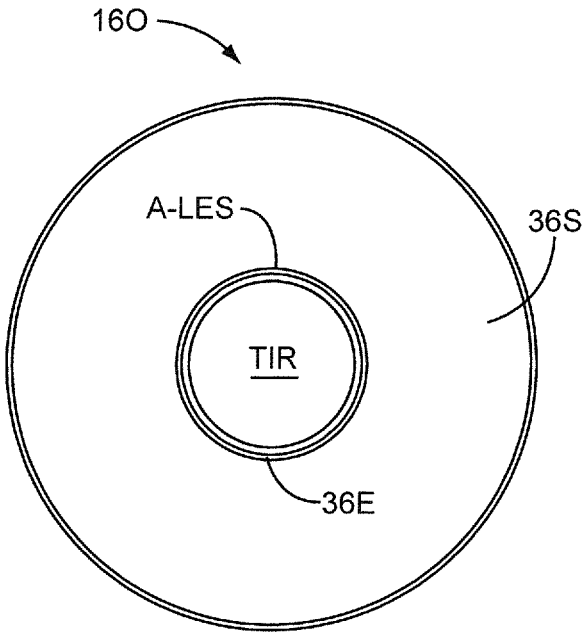
Figure 20D:
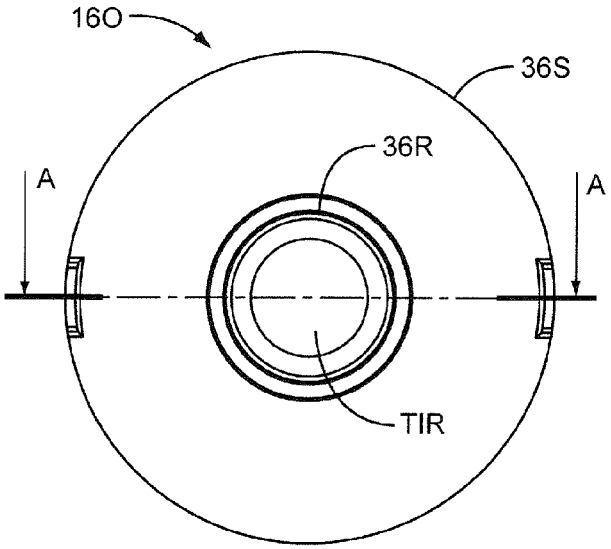
Figure 20E:
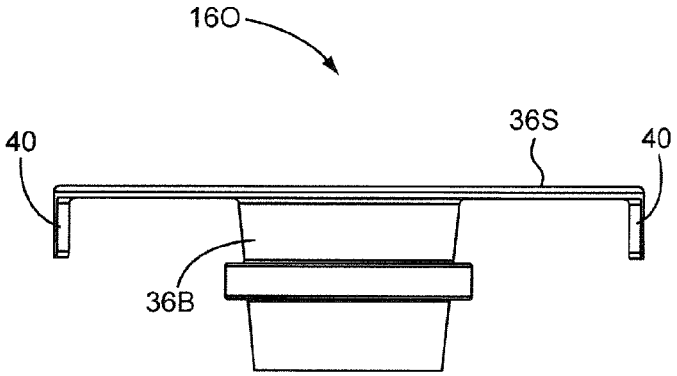
Figure 20F:
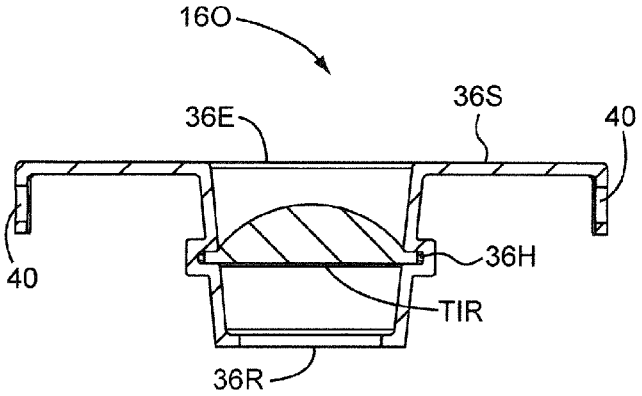
Figure 21A:
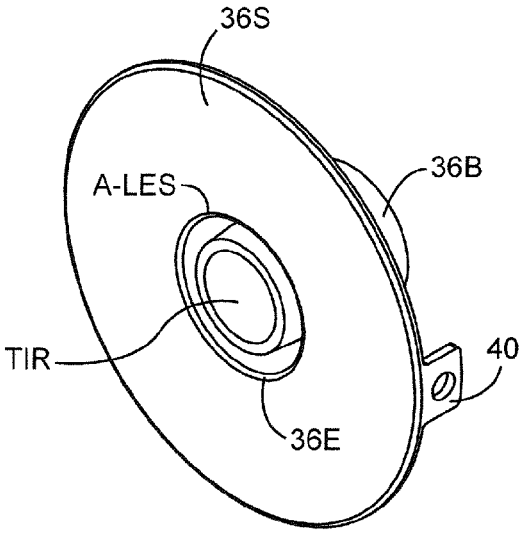
FIGS. 21A-21F are respective front isometric, rear isometric, front plan, rear plan, first side plan, and second side plan views of another embodiment of the internal optic.
Figure 21B:
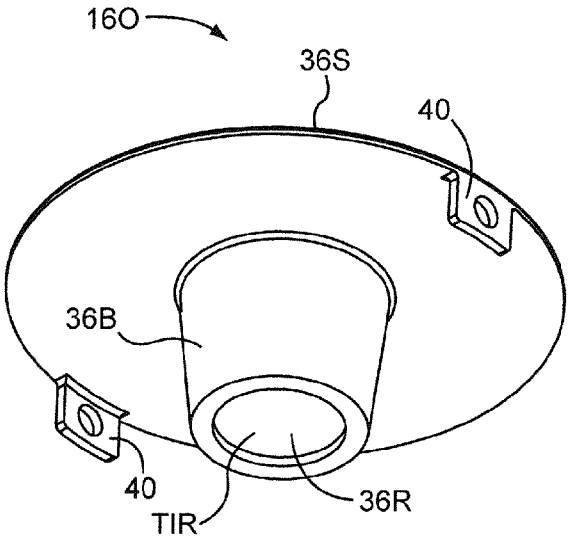
Figure 21C:
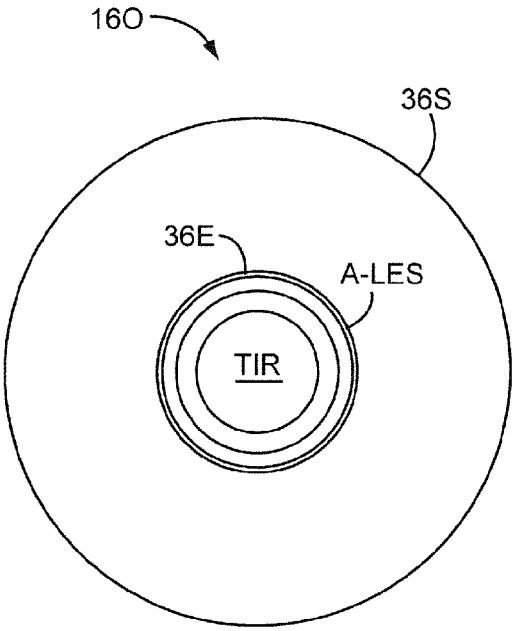
Figure 21D:
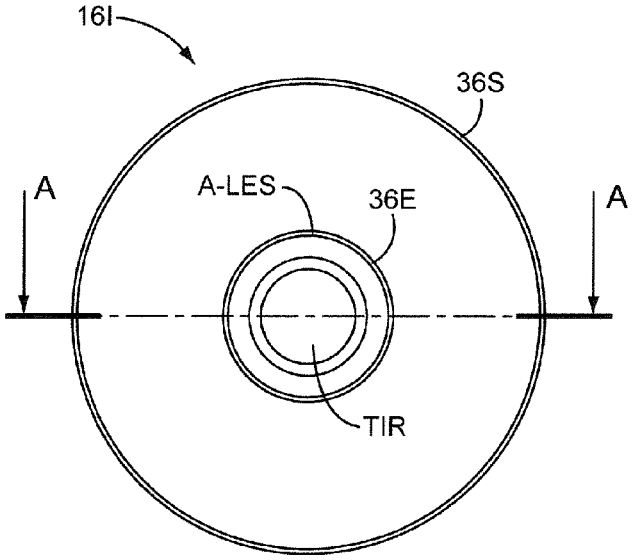
Figure 21E:
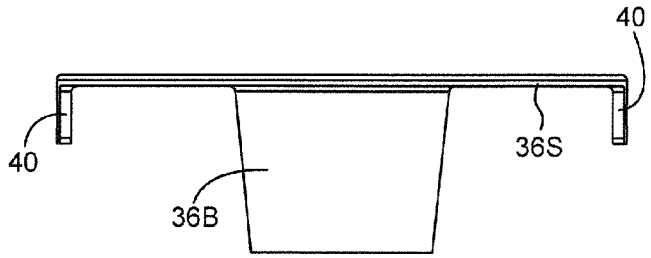
Figure 21F:
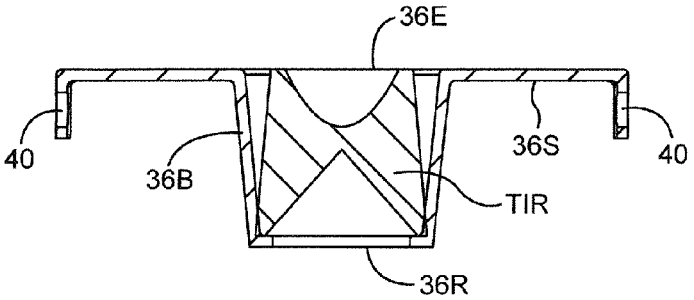

FIGS. 18F and 18G illustrate front and rear isometric views of the internal optic 36 residing in position within the lens assembly 16. The rest of the lighting fixture 10 is not illustrated. When used with the lens assembly 16, the semi-circular A-LES on the lens assembly 16 will correspond to the semi-circular light emitting opening 36E, as illustrated in the front isometric view of FIG. 18F.

As those skilled in the art will appreciate, all of the aforementioned configurations for the internal optic 36 can be applied to an integrated lens assembly 16O.

FIGS. 19A-19E provide various isometric, plan, and cross-sectional views of an alternative embodiment of the integrated lens assembly 16O. In this embodiment, the internal optic 36 and lens 36L of the previous embodiment are integrated to provide an internal lens 36I. As such, the integrated lens assembly 16O is primarily formed from the shroud 36S and the internal lens 36I. The shroud 36S is again annular in this example and may include the rearward extending tabs 40 along the perimeter or other mechanism for connecting the integrated lens assembly 16O to the mounting structure 14 in the same or similar manner as described above with the lens assembly 16.

The exterior of the internal lens 36I in this example is substantially parabolic and increases in diameter from a flat light emitting end 36E' to a light receiving end 36R'. The flat light emitting end 36E' aligns with a hole in the shroud 36S. The light receiving end 36R' leads to a parabolic cavity 36C within the lens 36L. Notably, the light emitting end 36E' of the internal lens 36I is solid, and thus, there is no opening in the light emitting end 36E' that leads to the cavity 36C. The light receiving end 36R' is sized to surround the array of LEDs 50. Further, the light emitting end 36E' need not be flat and can be concave, convex, smooth, textured, and the like depending on the lighting application. The light emitted from the array of LEDs 50 will be reflected through the hole in the shroud 36S via the light emitting end 36E'. As such, the A-LES will correspond to one of the hole in the shroud 36S and the light emitting end 36E', depending on the configuration. In this example, the hole in the shroud 36S and the light emitting end 36E' are substantially coincident and respective perimeters correspond to the A-LES. While a substantially parabolic internal lens 36I is shown, the internal lens 36I may take virtually any shape and will be constructed according to the needs of the lighting application.

The internal lens 36I and the shroud 36S may be separate and configured to mate together or may be integrally formed. In any of these embodiments, the internal lens 36I and the shroud 36S may be formed from the same or different materials and have the same or different degree of transparency, translucency, or opaqueness. For example, the internal lens 36I may be formed from an acrylic or silicon. The shroud 36S may be formed from a plastic or metal to provide a desired aesthetic or complement the light control properties provided by an exterior optic (not shown). For example, at least the exposed surface of the shroud 36S may match the appearance of the internal lens 36I, contrast with the appearance of the internal lens 36I, as well as have the same or different degree of transparency as the internal lens 36I. In essence, each part can be formed from the same or different components and have the same or different aesthetic. The internal lens 36I could also take the form of a total internal reflector (TIR).

FIGS. 20A-20F provide various isometric, plan, and cross-sectional views of the integrated lens assembly 16O, which employs a TIR. The integrated lens assembly 16O is primarily formed from the optic body 36B, shroud 36S, and the TIR. The shroud 36S is annular in this example and may include the rearward extending tabs 40 along the perimeter or other mechanism for connecting the integrated lens assembly 16O to the mounting structure 14 in the same or similar manner as described above with the lens assembly 16. As with the previous embodiment, the optic body 36B is conical and extends rearward from the larger, circular light emitting opening 36E and terminates at the slightly smaller, circular light receiving opening 36R.

The TIR can be integrally formed or mounted anywhere inside the optic body 36B. As illustrated, the TIR is recessed into the internal cavity of the optic body 36B and has a perimeter edge that snaps into an annular channel 36H (shown) or other connection mechanism formed into or on the inside wall of the optic body 36B to hold the TIR in place. The illustrated TIR has a flat rear surface and a convex front surface, but may take virtually any shape and be located at any position along the optic body 36B. The A-LES corresponds to the light emitting opening 36E.

In any of these embodiments, the optic body 36B, the shroud 36S, as well as the TIR may be formed from the same or different materials and have the same or different degree of transparency, translucency, or opaqueness. For example, the TIR may be formed from an acrylic, silicone, or the like, be translucent, and either coated or formed to provide the any desired diffusion. The optic body 36B and the shroud 36S may be formed from a plastic or metal to provide a desired aesthetic or complement the light control properties provided by an exterior optic (not shown). Further, the TIR may be replaced with a simple clear or diffused lens in an alternate embodiment.

Another embodiment of an integrated lens assembly 16O that employs a TIR is illustrated in FIGS. 21A through 21F. In this instance, the TIR wedges into the cavity provided by the optic body 36B and has a unique profile. With particular reference to the cross-sectional view of FIG. 21F, the outside of the TIR is conical, while the end of the TIR that is adjacent the light receiving opening 36R has a conical recess. The end of the TIR that is adjacent the light emitting opening 36E has a parabolic recess. These respective recesses, as well as the TIR, may take on various shapes and be attached to the optic body 36B in a variety of ways based on the demands of the lighting application as well as the desired configuration of the integrated lens assembly 16O and the lighting fixture 10 in general.

Figure 22:
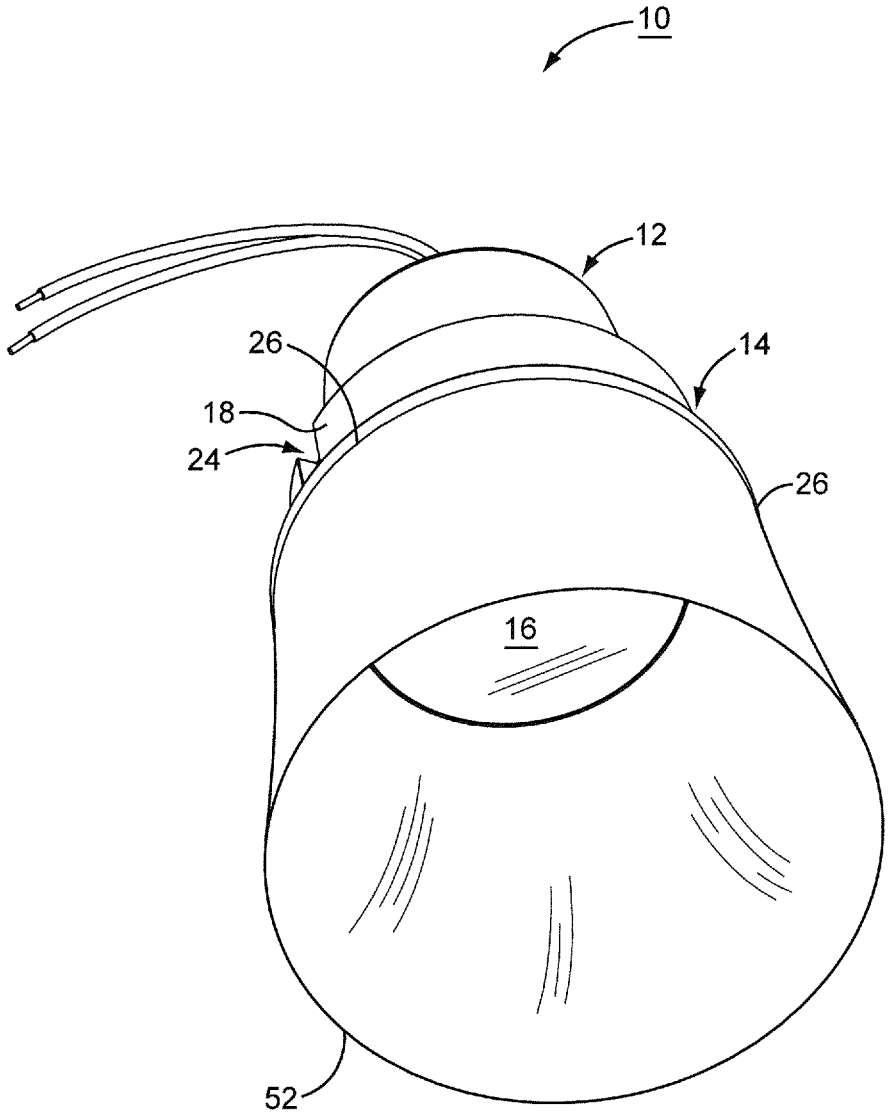
FIG. 22 is a lighting fixture with an external reflector according to one embodiment.

The lighting fixture 10 may be used in conjunction with any number of accessories. An exemplary accessory, such as an external optic or reflector 52, is shown in FIG. 22. The reflector 52 may be configured to mount to the annular flange 22 or other portion of the mounting structure 14. Further, the reflector 52 may be sized and shaped to provide a desired aesthetic as well as to coordinate with the internal optic 36 or an integrated lens assembly 16O to provide a desired output light pattern. As with the internal optic 36 and the integrated lens assembly 16O, the reflector 52 is modular and may be selected based on the internal optic 36, the integrated lens assembly 16O, desired aesthetics and the like.

Those skilled in the art will recognize improvements and modifications to the embodiments of the present disclosure. All such improvements and modifications are considered within the scope of the concepts disclosed herein.

What is claimed is:

1. A lighting fixture comprising:

a mounting structure having a cavity and a front opening in communication with the cavity and defining a maximum potential light emitting surface (LES) for the lighting fixture;

a light emitting diode (LED) light source associated with the mounting structure;

an internal optic comprising:

a shroud over the front opening and having a light emitting opening; and an optic body extending into the cavity toward the LED light source from the light emitting opening, which defines an actual LES that is substantially less than the maximum potential LES, and light emitted from the LED light source passes through the optic body toward the front opening; and a lens assembly attached to the mounting structure and covering the front opening, wherein the lens assembly comprises a lens portion that covers the light emitting opening.

2. The lighting fixture of claim 1 wherein the front opening has a first shape and the light emitting opening has a second shape, which is substantially different from the first shape.

3. The lighting fixture of claim 1 wherein the light emitting opening is not centered relative to the front opening.

4. The lighting fixture of claim 1 wherein the optic body terminates at a light receiving opening configured to receive the LED light source.

5. The lighting fixture of claim 4 wherein the light receiving opening has a first shape and the light emitting opening has a second shape, which is substantially different from the first shape.

6. The lighting fixture of claim 4 wherein the light receiving opening has a first shape and the light emitting opening has a second shape, which is substantially the same as the first shape.

7. The lighting fixture of claim 1 wherein the actual LES has an area that is less than about 70% of an area of the maximum potential LES.

8. The lighting fixture of claim 1 wherein the actual LES has an area that is less that about 50% of an area of the maximum potential LES.

9. The lighting fixture of claim 8 wherein the front opening has a first shape and the light emitting opening has a second shape, which is substantially different from the first shape.

10. The lighting fixture of claim 8 wherein the light emitting opening is not centered relative to the front opening.

11. The lighting fixture of claim 1 wherein the actual LES has an area that is less that about 30% of an area of the maximum potential LES.

12. The lighting fixture of claim 1 wherein the actual LES has an area that is less that about 20% of an area of the maximum potential LES.

13. The lighting fixture of claim 1 wherein the optic body is conical.

14. The lighting fixture of claim 1 wherein the optic body is pyramidal.

15. The lighting fixture of claim 1 wherein the lens assembly:

holds the internal optic within the cavity of the mounting structure such that the internal optic is not otherwise affixed to the mounting structure;

is separate from the internal optic; and has at least a portion that covers the light emitting opening and acts as a lens for the lighting fixture.

16. The lighting fixture of claim 15 wherein the lens assembly further comprises at least one tab that is coupled to the mounting structure.

17. The lighting fixture of claim 16 wherein the at least one tab is coupled to an interior surface of at least one sidewall of the mounting structure.

18. The lighting fixture of claim 17 wherein the lens portion is substantially perpendicular to a central axis of the mounting structure and the at least one tab is substantially parallel to the central axis.

19. The lighting fixture of claim 18 wherein the interior surface of the at least one sidewall comprises at least one channel in which the at least one tab is received.

20. The lighting fixture of claim 1 wherein the mounting structure comprises a heat spreading cup having a bottom panel, a rim, and at least one sidewall extending between the bottom panel and the rim, and the LED light source is coupled inside the heat spreading cup to the bottom panel and configured to emit light in a forward direction through the front opening, which is formed by the rim, wherein the LED light source is thermally coupled to the bottom panel such that heat generated by the LED light source during operation is transferred radially outward along the bottom panel and in the forward direction along the at least one sidewall toward the rim.

21. A lighting fixture comprising:

a mounting structure having a cavity and a front opening in communication with the cavity and defining a maximum potential light emitting surface (LES) for the lighting fixture;

a light emitting diode (LED) light source associated with the mounting structure; and an internal optic comprising:

a shroud over the front opening having a light emitting opening; and an optic body extending into the cavity toward the LED light source from the light emitting opening, wherein light emitted from the LED light source passes through the optic body toward the front opening; and a lens assembly removably attachable to the mounting structure and covering the front opening, wherein when attached to the mounting structure, the lens assembly holds the internal optic within the cavity of the mounting structure such that internal optic is not otherwise affixed to the mounting structure, and the light emitting opening defines on the lens assembly an actual LES that is substantially less than the maximum potential LES, the lens assembly comprising a lens portion that covers the light emitting opening.

* * * * *